US011781734B2

(12) United States Patent
Tone et al.

(10) Patent No.: US 11,781,734 B2
(45) Date of Patent: Oct. 10, 2023

(54) LENS COMPONENT AND SIGNAL DISPLAY LAMP

(71) Applicant: PATLITE CORPORATION, Osaka (JP)

(72) Inventors: Yusuke Tone, Osaka (JP); Daisuke Shigematsu, Osaka (JP)

(73) Assignee: PATLITE CORPORATION, Osaka (JP)

( * ) Notice: Subject to any disclaimer, the term of this patent is extended or adjusted under 35 U.S.C. 154(b) by 0 days.

(21) Appl. No.: 17/783,349

(22) PCT Filed: Sep. 16, 2020

(86) PCT No.: PCT/JP2020/035077
§ 371 (c)(1),
(2) Date: Jun. 8, 2022

(87) PCT Pub. No.: WO2022/059092
PCT Pub. Date: Mar. 24, 2022

(65) Prior Publication Data

US 2023/0020496 A1 Jan. 19, 2023

(51) Int. Cl.
*F21V 5/04* (2006.01)
*F21V 9/40* (2018.01)
(Continued)

(52) U.S. Cl.
CPC ..... *F21V 5/043* (2013.01); *F21V 5/02* (2013.01); *F21V 5/046* (2013.01); *F21V 7/0091* (2013.01);
(Continued)

(58) Field of Classification Search
CPC . F21V 5/02; F21V 5/043; F21V 5/046; F21V 7/0091; F21V 9/40
See application file for complete search history.

(56) References Cited

U.S. PATENT DOCUMENTS

2010/0315811 A1* 12/2010 Chen ..... F21V 13/04 362/235
2015/0323142 A1* 11/2015 Shigematsu ..... F21K 9/61 362/235
2017/0276319 A1 9/2017 Shigematsu

FOREIGN PATENT DOCUMENTS

EP 3263971 A1 1/2016
JP 2005-251689 A 9/2005
(Continued)

*Primary Examiner* — Evan P Dzierzynski
*Assistant Examiner* — Nathaniel J Lee
(74) *Attorney, Agent, or Firm* — Rabin & Berdo, P.C.

(57) ABSTRACT

A lens component radiates light from a light source. The lens component includes a light guiding radiation portion. The light guiding radiation portion includes a light incidence portion having an incidence surface on which the light from the light source is made incident, and a plurality of radiation mechanisms that respectively radiate to a plurality of radiation angle ranges. The incidence surface includes a close side incidence region and a distant side incidence region. The radiation angle ranges include a close side radiation angle range and a distant side radiation angle range. The light incident on the close side incidence region is radiated to the distant side radiation angle range via a corresponding distant side radiation mechanism. The light incident on the distant side incidence region is radiated to the close side radiation angle range via a corresponding close side radiation mechanism.

17 Claims, 19 Drawing Sheets

(51) Int. Cl.

| | |
|---|---|
| ***F21V 7/00*** | (2006.01) |
| ***F21V 5/02*** | (2006.01) |
| *F21Y 115/10* | (2016.01) |
| *F21Y 103/10* | (2016.01) |
| *F21Y 107/90* | (2016.01) |

(52) U.S. Cl.
CPC ..... *F21V 9/40* (2018.02); *F21Y 2103/10* (2016.08); *F21Y 2107/90* (2016.08); *F21Y 2115/10* (2016.08)

(56) References Cited

FOREIGN PATENT DOCUMENTS

| | | | |
|---|---|---|---|
| JP | 5954600 | B2 | 7/2016 |
| WO | 2017/022143 | A1 | 2/2017 |

* cited by examiner

LENS COMPONENT AND SIGNAL DISPLAY LAMP

TECHNICAL FIELD

The present invention relates to a lens component and a signal display lamp.

BACKGROUND ART

A signal display lamp disclosed in Patent Literature 1 includes a lens component in which a tubular light guiding radiation portion is provided to contain an LED mounting substrate. An LED is mounted at a position deviated from the central position in the short direction of the LED mounting substrate toward the end portion side. A slit portion cut out in the axial direction is formed in the light guiding radiation portion. When the lens component contains the LED mounting substrate, the LED is disposed in the slit portion.

Light that is made incident from incidence surfaces which are a pair of opposing end surfaces of the slit portion into the lens component is guided by the light guiding radiation portion and radiated to the outside in most regions in the circumferential direction of the light guiding radiation portion. On the other hand, with respect to the outside in a direction orthogonal to an optical axis, irradiated light not made incident on the incidence surfaces but leaked out from the slit portion is made incident on an auxiliary lens portion and radiated from the auxiliary lens portion as exiting light.

CITATION LIST

Patent Literature

Patent Literature 1: Japanese Patent No. 5954600

SUMMARY OF INVENTION

Technical Problem

Regarding the light that is made incident from an incidence portion and radiated after being guided to a circumferential part on the side relatively far from a light source in the light guiding radiation portion, the amount of light is lowered as compared to light radiated after being guided to a circumferential part relatively close to the light source, and visibility is thus lowered. This is because, in a case where the light is guided to the circumferential part on the side relatively far from the light source as in the former, loss of light at the time of light guiding becomes larger.

A preferred embodiment of the present invention provides a lens component and a signal display lamp capable of suppressing an influence of loss of light at the time of light guiding and improving visibility.

Solution to Problem

A preferred embodiment of the present invention provides a lens component for radiating to a periphery light emitted by a light source having a light distribution characteristic in which luminosity becomes smaller with an increase in distance away from an optical axis. The lens component includes a light guiding radiation portion formed in a cylindrical or partially cylindrical shape having a central axis line, the light guiding radiation portion having an outer peripheral portion and an inner peripheral portion, the light guiding radiation portion guides the light from the light source and radiates the light radially away from the central axis line toward a periphery of the central axis line. The light source is disposed at a predetermined light source position separated from a second axis line among first and second axis lines which are orthogonal to the central axis line and orthogonal to each other in a direction of the first axis line by aligning the optical axis with an optical axis line which is parallel to the second axis line. The light guiding radiation portion includes a light incidence portion having an incidence surface on which the light from the light source disposed at the light source position is made incident, and a plurality of radiation mechanisms that respectively guide and radiate the light that is made incident from the light incidence portion to a plurality of radiation angle ranges respectively defined by a plurality of central angles centered on the central axis line. The incidence surface includes a plurality of incidence regions which collect the light from the light source disposed at the light source position and respectively make the light incident on the plurality of radiation mechanisms. The plurality of incidence regions include a close side incidence region close to the optical axis line and a distant side incidence region disposed farther from the optical axis line than the close side incidence region. When viewed from a direction of the central axis line, the plurality of radiation angle ranges include a close side radiation angle range closer to the first axis line than the second axis line and a distant side radiation angle range farther from the first axis line and closer to the second axis line than the close side radiation angle range. The radiation mechanisms include a close side radiation mechanism that radiates the light to the close side radiation angle range and a distant side radiation mechanism that radiates the light to the distant side radiation angle range. The light that is made incident on the close side incidence region is radiated to the distant side radiation angle range via the corresponding distant side radiation mechanism, and the light that is made incident on the distant side incidence region is radiated to the close side radiation angle range via the corresponding close side radiation mechanism.

With this lens component, light guiding for radiating to the close side radiation angle range that is on the side close to the first axis line, a light guiding distance in the light guiding radiation portion is relatively short, and loss of light at the time of light guiding is relatively small. Light guiding for radiating to the distant side radiation angle range that is on the side close to the second axis line and far from the first axis line, the light guiding distance in the light guiding radiation portion is relatively long, and the loss of light at the time of light guiding is relatively large.

On the other hand, light of relatively high luminosity that is made incident on the close side incidence region that is on the side close to the optical axis line is radiated to the distant side radiation angle range via the corresponding distant side radiation mechanism. Light of relatively low luminosity that is made incident on the distant side incidence region on the side far from the optical axis line is radiated to the close side radiation angle range via the corresponding close side radiation mechanism. Therefore, by suppressing an influence of the loss of light at the time of light guiding, it is possible to radiate to an entire region in the circumferential direction with a uniform amount of light, and improve visibility.

In a preferred embodiment, an optical path length in the light guiding radiation portion before the light that is made incident on the close side incidence region is radiated to the distant side radiation angle range via the corresponding distant side radiation mechanism is longer than an optical path length in the light guiding radiation portion before the light that is made incident on the distant side incidence region is radiated to the close side radiation angle range via the corresponding close side radiation mechanism.

In this preferred embodiment, the light of relatively high luminosity that is made incident on the close side incidence region is guided to an optical path on the side where the optical path length is relatively long and the loss of light becomes relatively large, that is, on the side where the light is radiated to the distant side radiation angle range. The light of relatively low luminosity that is made incident on the distant side incidence region is guided to an optical path on the side where the optical path length is relatively short and the loss of light becomes relatively small, that is, on the side where the light is radiated to the close side radiation angle range. Therefore, it is possible to radiate to an entire region in the circumferential direction with a uniform amount of light, and improve visibility.

In a preferred embodiment, the distant side incidence region includes first and second incidence regions disposed on opposite sides to each other with respect to the optical axis line. The close side incidence region includes a third incidence region disposed between the first incidence region and the optical axis and a fourth incidence region disposed between the second incidence region and the optical axis line. When viewed from the direction of the central axis line, the close side radiation angle range includes a first radiation angle range adjacent to the first axis line and a second radiation angle range adjacent to the opposite side of the first axis line with respect to the first radiation angle range. When viewed from the direction of the central axis line, the distant side radiation angle range includes a third radiation angle range adjacent to the opposite side of the first radiation angle range with respect to the second radiation angle range and a fourth radiation angle range adjacent to the third radiation angle range side with respect to the second axis line. Incident light from the first incidence region, the second incidence region, the third incidence region, and the fourth incidence region is guided via the corresponding radiation mechanisms and respectively radiated to the first radiation angle range, the second radiation angle range, the third radiation angle range, and the fourth radiation angle range.

In this preferred embodiment, the first incidence region and the second incidence region each serving as the distant side incidence region are disposed on both sides of the optical axis line. The third incidence region and the fourth incidence region each serving as the close side incidence region are disposed on both sides of the optical axis line and disposed between the first incidence region and the second incidence region. Thereby, it is possible to effectively use the incidence regions.

It is also possible to establish a practical correspondence between each of the incidence regions and each of the radiation angle ranges. That is, the incident light from the first incidence region and the second incidence region each serving as the distant side incidence region is guided via the corresponding radiation mechanisms and respectively radiated to the first radiation angle range and the second radiation angle range each serving as the close side radiation angle range. The incident light from the third incidence region and the fourth incidence region each serving as the close side incidence region is guided via the corresponding radiation mechanisms and respectively radiated to the third radiation angle range and the fourth radiation angle range each serving as the distant side radiation angle range.

In a preferred embodiment, the close side radiation mechanism includes a first radiation mechanism that radiates light to the first radiation angle range serving as the close side radiation angle range adjacent to the first axis line when viewed from the direction of the central axis line. The first radiation mechanism includes a first reflection surface which is an internal reflection surface along a first inner surface opposing the rear side of the incidence surface among inner surfaces of an outside axial groove formed in the outer peripheral portion and totally reflects the incident light from the first incidence region serving as the distant side incidence region of the incidence surface and a first exit surface which is provided in the outer peripheral portion and transmits and exits the reflected light from the first reflection surface to the first radiation angle range.

In this preferred embodiment, by the first radiation mechanism, the incident light from the first incidence region is totally reflected on the first reflection surface and the reflected light from the first reflection surface is transmitted and exited from the first exit surface to the first radiation angle range that is on the side substantially orthogonal to the optical axis line. This preferred embodiment has the following advantages with respect to the prior art described above.

That is, in the prior art described above, the light that is made incident on the auxiliary lens portion for radiating to the side substantially orthogonal to the optical axis line is direct irradiation light leaked out from the slit portion, and it is the light within a narrow irradiation range which is the farthest from the optical axis line. On the other hand, in this preferred embodiment, the first reflection surface is the internal reflection surface along the first inner surface opposing the rear side of the incidence surface among the inner surfaces of the outside axial groove of the outer peripheral portion. Therefore, it is possible to use the light over a wider irradiation range on the closer side to the optical axis line as compared to the prior art, and it is thus possible to increase the amount of light as compared to the prior art with respect to a direction substantially orthogonal to the optical axis line.

In a preferred embodiment, when viewed from the direction of the central axis line, the first reflection surface is disposed within a range of a central angle that defines the second radiation angle range adjacent to the opposite side of the first axis line with respect to the first radiation angle range. In this preferred embodiment, by providing an appropriate distance between the light source and the first reflection surface, the degree of freedom of setting an area of the first reflection surface, inclination of the first reflection surface with respect to the optical axis, etc., is improved. Therefore, it is possible to guide the light over a wide irradiation range from the light source to the first reflection surface and reflect to the first exit surface side. Thus, it is possible to increase the amount of light of the first radiation angle range and improve visibility.

In a preferred embodiment, the first reflection surface includes a light collecting surface and the first exit surface includes a refractive surface which refracts and emits the reflected light from the first reflection surface such as to lead the reflected light to the central side of the first radiation angle range. In this preferred embodiment, it is possible to improve visibility of the first radiation angle range.

In a preferred embodiment, the close side radiation mechanism includes a second radiation mechanism that radiates light to the second radiation angle range serving as the close side radiation angle range adjacent to the opposite side of the first axis line with respect to the first radiation angle range when viewed from the direction of the central axis line. The second radiation mechanism includes a second reflection surface which is an internal reflection surface along the inner peripheral portion and totally reflects the incident light from the second incidence region serving as the distant side incidence region of the incidence surface and a second exit surface which is provided in the outer peripheral portion and transmits and exits the reflected light from the second reflection surface to the second radiation angle range. In this preferred embodiment, by the second radiation mechanism, the incident light from the second incidence region is totally reflected on the second reflection surface and the reflected light from the second reflection surface is transmitted and exited from the second exit surface to the second radiation angle range.

In a preferred embodiment, the second exit surface includes a refractive surface which refracts and emits the reflected light from the second reflection surface such as to lead the reflected light to the central side of the second radiation angle range. In this preferred embodiment, it is possible to improve visibility from the second radiation angle range.

In a preferred embodiment, the distant side radiation mechanism includes a third radiation mechanism that radiates light to the third radiation angle range serving as the distant side radiation angle range adjacent to the opposite side of the first radiation angle range with respect to the second radiation angle range when viewed from the direction of the central axis line. The third radiation mechanism includes a first light guiding surface which is a light guiding surface along the outer peripheral portion and totally reflects the incident light from the third incidence region serving as the close side incidence region of the incidence surface, a second light guiding surface which is a light guiding surface along the inner peripheral portion and totally reflects the reflected light from the first light guiding surface, a third reflection surface which is an internal reflection surface along a first inner surface of an inside axial groove formed in the inner peripheral portion and totally reflects the reflected light from the second light guiding surface, and a third exit surface which is provided in the outer peripheral portion and transmits and exits the reflected light from the third reflection surface to the third radiation angle range.

In this preferred embodiment, by an action of the third radiation mechanism, the light that is made incident from the third incidence region is totally reflected successively on the first light guiding surface along the outer peripheral portion, the second light guiding surface and the third reflection surface along the inner peripheral portion, and the reflected light from the third reflection surface is transmitted and exited from the third exit surface of the outer peripheral portion to the third radiation angle range. Since the third reflection surface is formed by the internal reflection surface along the first inner surface of the inside axial groove formed in the inner peripheral portion, it is possible to easily obtain the desired third reflection surface without increasing the size of the light guiding radiation portion.

In a preferred embodiment, the first light guiding surface is disposed along the second exit surface of the second radiation mechanism and the second light guiding surface and the third reflection surface are disposed within a range of a central angle that defines the third radiation angle range. In this preferred embodiment, the second exit surface of the second radiation mechanism and the first light guiding surface of the third radiation mechanism are constituted of a common part and the second light guiding surface and the third reflection surface of the third radiation mechanism are collectively disposed, and it is thus possible to achieve downsizing. It is also possible to reduce the loss of light by shortening the optical path length in the light guiding radiation portion in the third radiation mechanism.

In a preferred embodiment, the distant side radiation mechanism includes a fourth radiation mechanism that radiates light to the fourth radiation angle range serving as the distant side radiation angle range adjacent to the third radiation angle range side with respect to the second axis line when viewed from the direction of the central axis line. The fourth radiation mechanism includes the first light guiding surface functioning as a reflection surface which totally reflects the incident light from the fourth incidence region serving as the close side incidence region of the incidence surface, the third reflection surface functioning as a transmission surface which transmits the reflected light from the first light guiding surface into the inside axial groove, a re-incidence surface serving as a second inner surface which opposes the first inner surface among the inner surfaces of the inside axial groove and makes the transmitted light transmitted through the third reflection surface incident again, a fourth reflection surface which is an internal reflection surface along the inner peripheral portion of the light guiding radiation portion and totally reflects the re-incident light that is made incident from the re-incidence surface, and a fourth exit surface which is provided in the outer peripheral portion and transmits and exits the reflected light from the fourth reflection surface to the fourth radiation angle range.

In this preferred embodiment, by an action of the fourth radiation mechanism, the incident light from the fourth incidence region is totally reflected on the first light guiding surface along the outer peripheral portion and the reflected light from the first light guiding surface is transmitted through the third reflection surface functioning as the transmission surface into the inside axial groove. The transmitted light transmitted through the third reflection surface is made incident again from the re-incidence surface formed by the second inner surface of the inside axial groove. The re-incident light from the re-incidence surface is totally reflected on the fourth reflection surface along the inner peripheral portion. The reflected light from the fourth reflection surface is transmitted and exited from the fourth exit surface of the outer peripheral portion to the fourth radiation angle range. In the fourth radiation mechanism, the third reflection surface of the third radiation mechanism functions as the transmission surface. Therefore, without increasing the size of the light guiding radiation portion, it is possible to effectively utilize an interior of the light guiding radiation portion as an optical path of the third radiation mechanism and the fourth radiation mechanism.

In a preferred embodiment, the re-incidence surface and the fourth reflection surface are disposed within a range of a central angle that defines the fourth radiation angle range. In this preferred embodiment, since the re-incidence surface and the fourth reflection surface are collectively disposed, it is possible to achieve downsizing. It is also possible to reduce the loss of light by shortening the optical path length in the light guiding radiation portion in the fourth radiation mechanism.

In a preferred embodiment, the third reflection surface functions as a light collecting reflection surface in the third radiation mechanism and functions as a diffusing transmission surface in the fourth radiation mechanism. In this preferred embodiment, because the third reflection surface functions as the light collecting reflection surface in the third radiation mechanism, the third reflection surface functions as the diffusing transmission surface in the fourth radiation mechanism. Therefore, in a case where the re-incidence surface includes a light collecting surface, it is possible to obtain a larger effect to suppress diffusion of light and improve visibility of the fourth radiation angle range.

A preferred embodiment of the present invention provides a signal display lamp including the lens component and a light source disposed at a light source position of the lens component. With this signal display lamp, it is possible to obtain the operations and effects described above in relation to the lens component.

In a preferred embodiment, the light source includes a first pair of light sources and/or a second pair of light sources that share optical axes with each other and emit light in directions directly opposite to each other, and the first pair of light sources and/or the second pair of light sources are positioned on opposite sides to each other in the direction of the first axis line with respect to the central axis line. In this preferred embodiment, each of the light sources corresponds to one-fourth of the entire circumference of the radiation angle ranges, and it is possible to improve the amount of light and enhance visibility.

In a preferred embodiment, a substrate having the direction of the central axis line as the longitudinal direction and the direction of the first axis line as the short direction is further included, the pairs of light sources are respectively mounted on surfaces on both sides of the substrate, the lens component is formed in a cylindrical shape, a pair of holding grooves in the axial direction which respectively house and hold a pair of end edges of the short direction of the substrate are formed in the inner peripheral portion of the light guiding radiation portion of the lens component and the pairs of light sources are respectively disposed at light source positions on both sides of the substrate via the substrate. In this preferred embodiment, in the substrate having the direction of the central axis line of the light guiding radiation portion as the longitudinal direction, by holding the pair of end edges of the short direction by the holding grooves in the axial direction of the light guiding radiation portion, it is possible to realize the signal display lamp with a practical structure.

In a preferred embodiment, the lens component includes a pair of light source housing recessed portions which are respectively adjacent to each of the pair of holding grooves and respectively house the light sources on both sides of the substrate and a convex lens surface serving as the incidence surface which projects toward the corresponding light source is formed on a bottom of each of the light source housing recessed portions. In this preferred embodiment, it is possible to collect and make light incident on the incidence surface where the convex lens surface is formed.

In a preferred embodiment, the substrate is disposed so as to offset in a direction of the second axis line with respect to the central axis line. In this preferred embodiment, it is possible to increase the degree of freedom of design. It is also possible to ensure a space on the opposite side of the offset side.

In a preferred embodiment, the cylindrical lens components are capable of being coupled in the axial direction, each of the lens components includes a cylindrical or partially cylindrical coupling portion inside the light guiding radiation portion and the coupling portions of the adjacent lens components are fitted and coupled to each other. In this preferred embodiment, by coupling the desired number of lens components in the axial direction, it is possible to realize a signal display lamp having a different length.

In a preferred embodiment, the lens component includes a plurality of divided pieces divided in the circumferential direction and combined with each other. In this preferred embodiment, since a shape of the divided pieces of the lens component is simplified as compared to a case where the lens component is not divided, it is easy to manufacture. It is also possible to realize the lens component corresponding to various angle ranges by using basic parts in a small variety of types.

In a preferred embodiment, when viewed from the direction of the central axis line, the lens component assumes a partially cylindrical shape with the second axis line as a chord. In this preferred embodiment, it is possible to radiate to, on both sides across the first axis line from the first pair of light sources, the radiation angle range of 90° for each side, that is, 180° in total.

In a preferred embodiment, when viewed from the direction of the central axis line, the lens component assumes a partially cylindrical shape with the first axis line as a chord, and the light source includes a pair of light sources which are positioned on opposite sides to each other in the direction of the first axis line with respect to the central axis line and emit light on the same side in a direction parallel to the second axis line. In this preferred embodiment, it is possible to radiate to, on both sides across the second axis line from the pair of light sources that emit light on the same side, the radiation angle range of 90° for each side, that is, 180° in total.

DESCRIPTION OF EMBODIMENTS

A preferred embodiment of the present invention shall now be described specifically with reference to the drawings.

Figure 1:
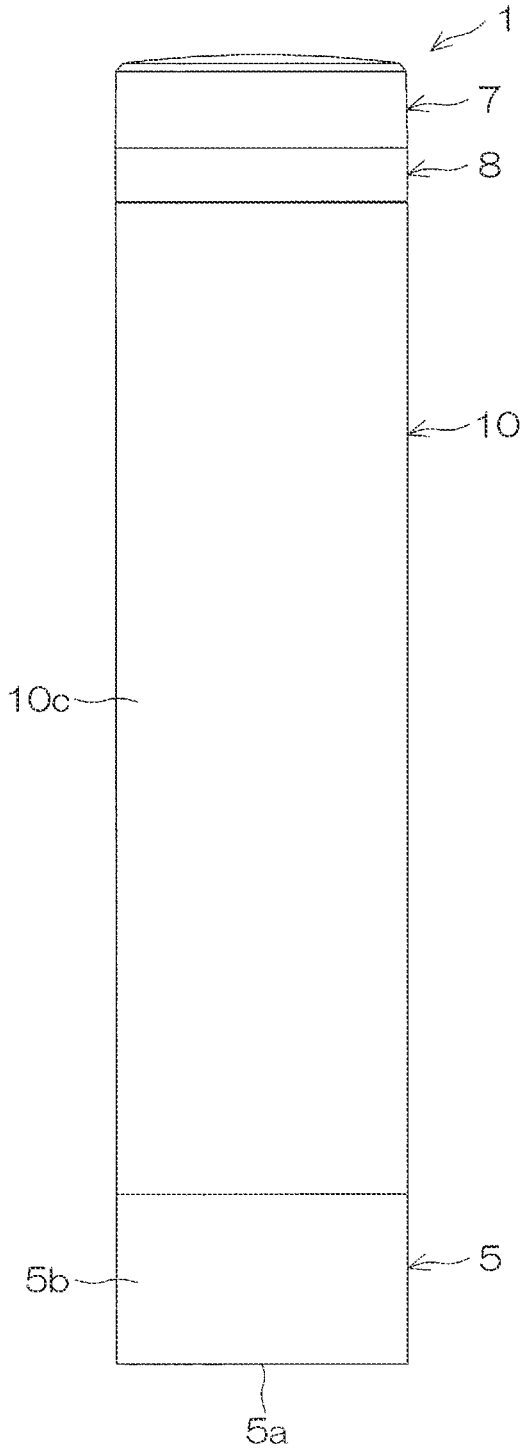
FIG. 1 is a front view of a signal display lamp of a preferred embodiment of the present invention.
Figure 2:
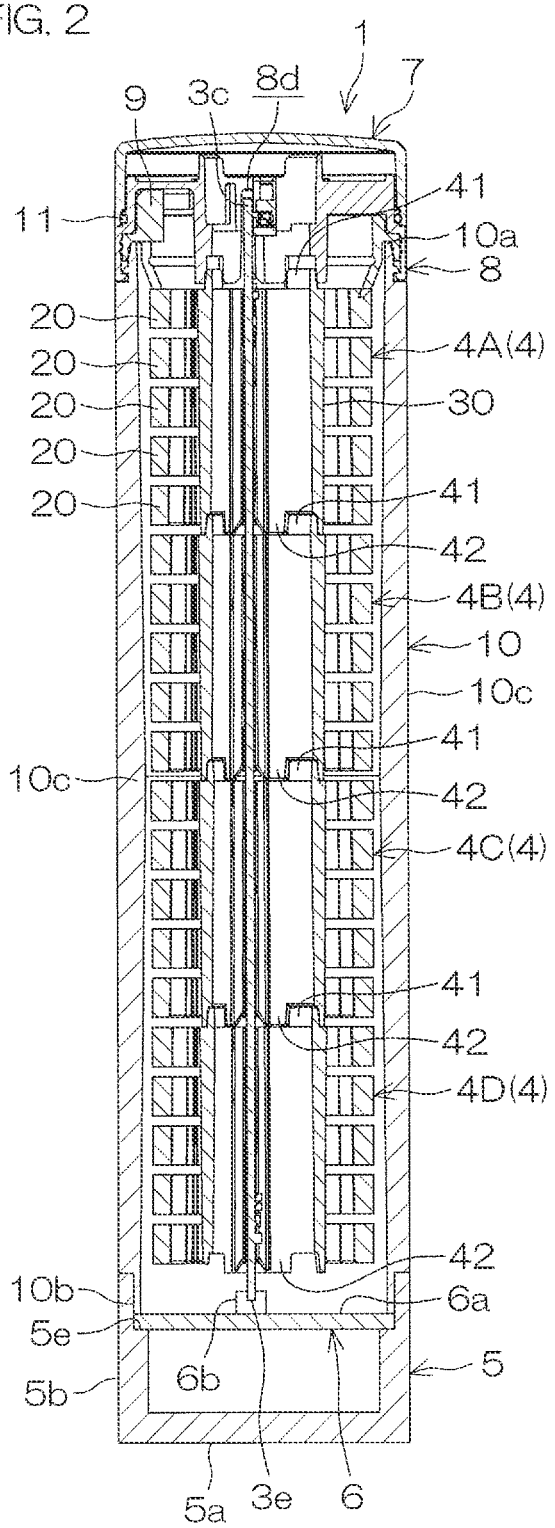
FIG. 2 is a longitudinal cross-sectional view of the signal display lamp.
Figure 3:
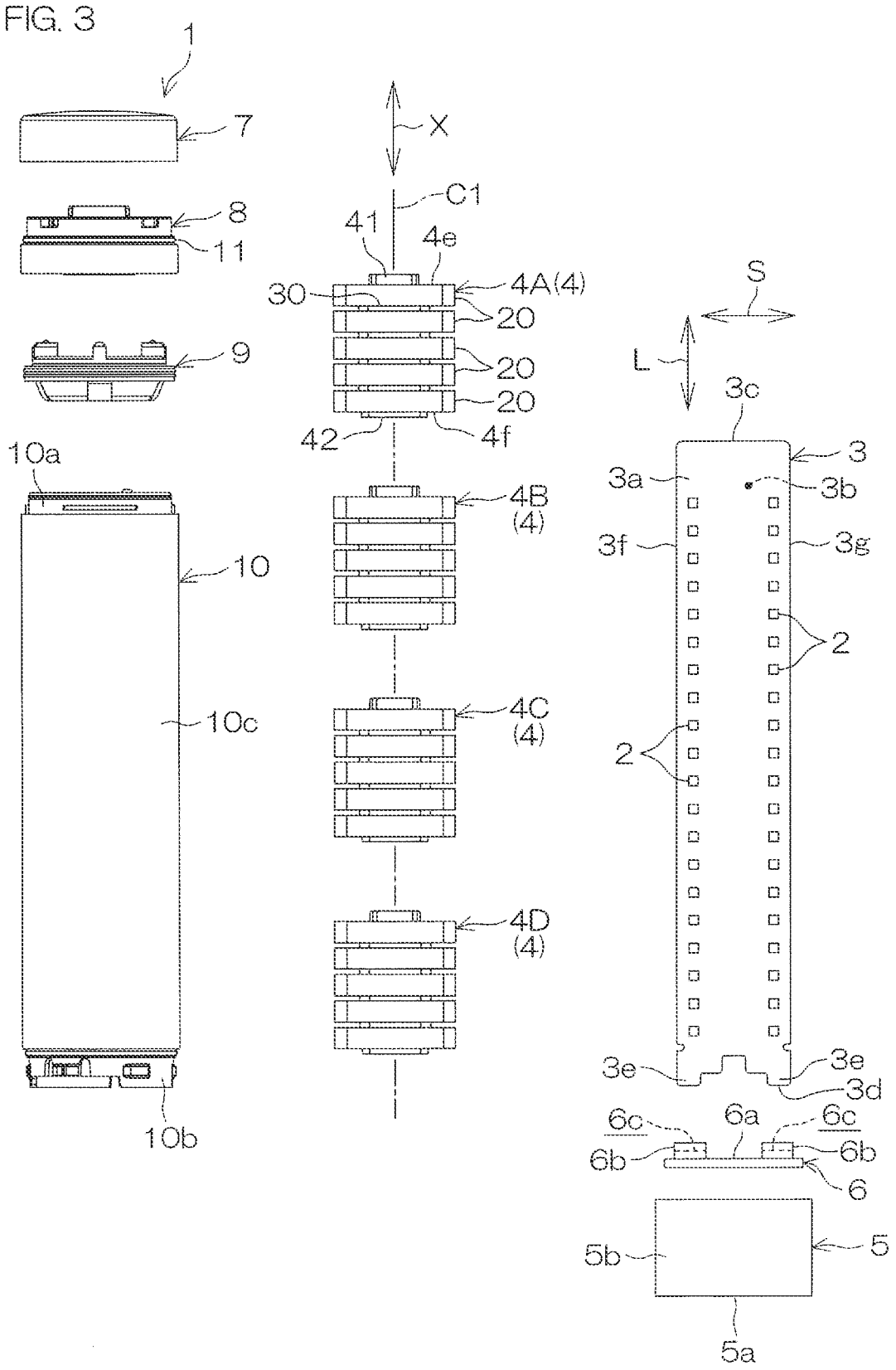
FIG. 3 is an exploded view of the signal display lamp.
Figure 4:
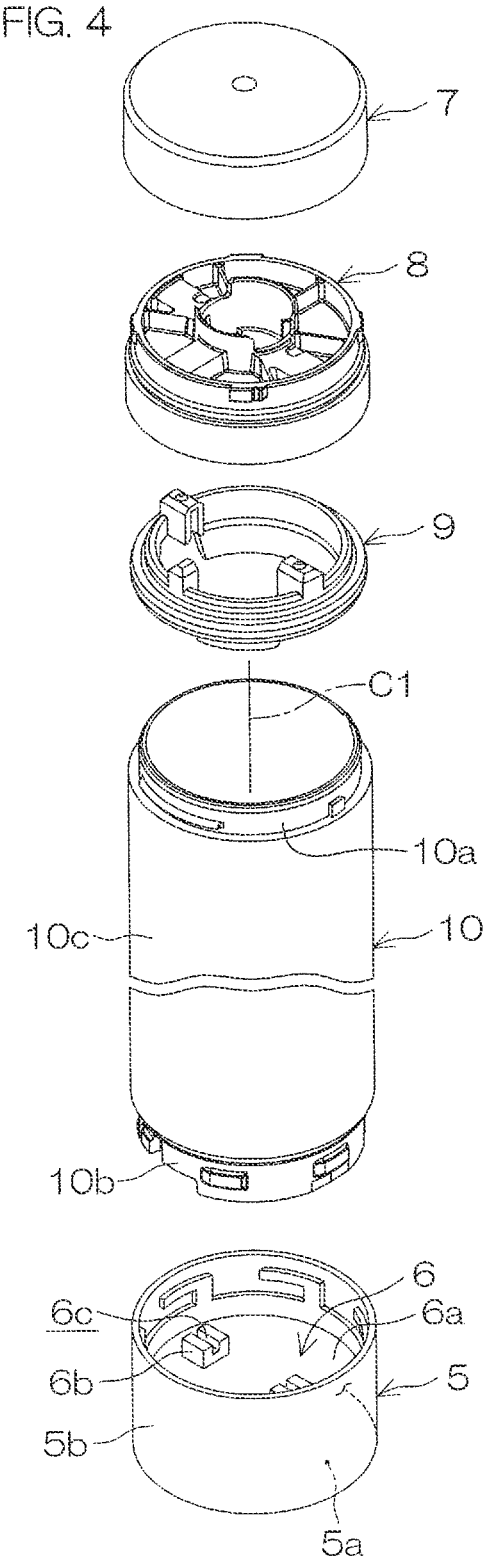
FIG. 4 is an exploded partial perspective view of components of the signal display lamp.
Figure 5A:
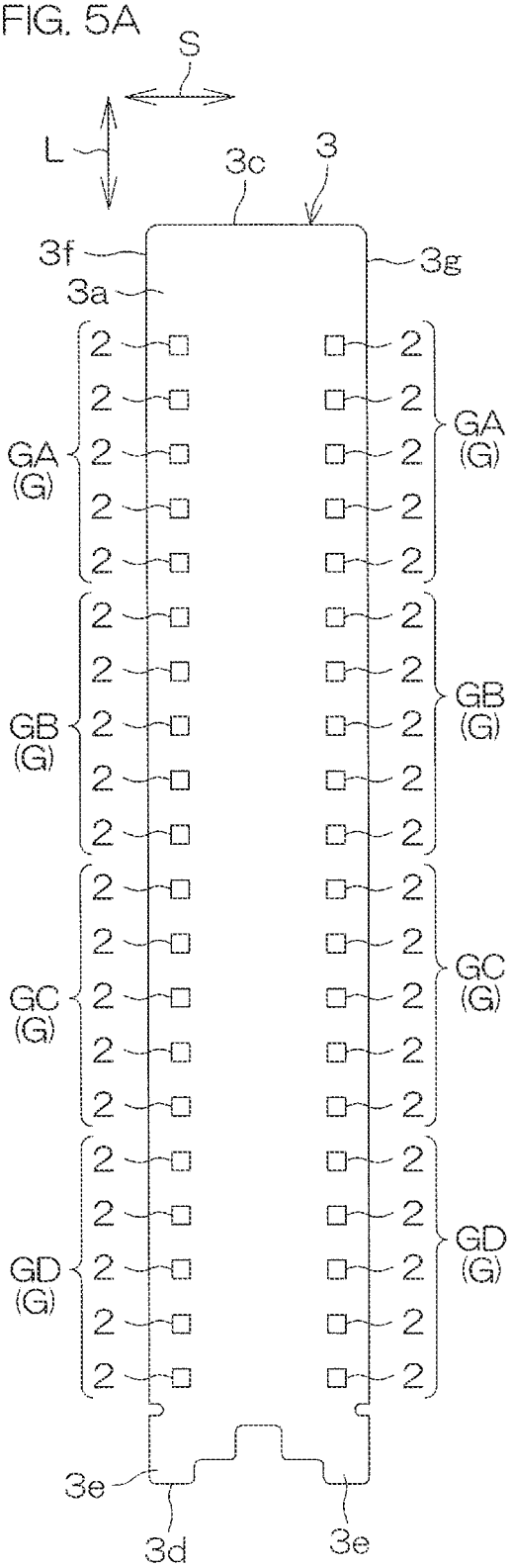
FIG. 5A is a front view of a substrate which is a component of the signal display lamp.
Figure 5B:
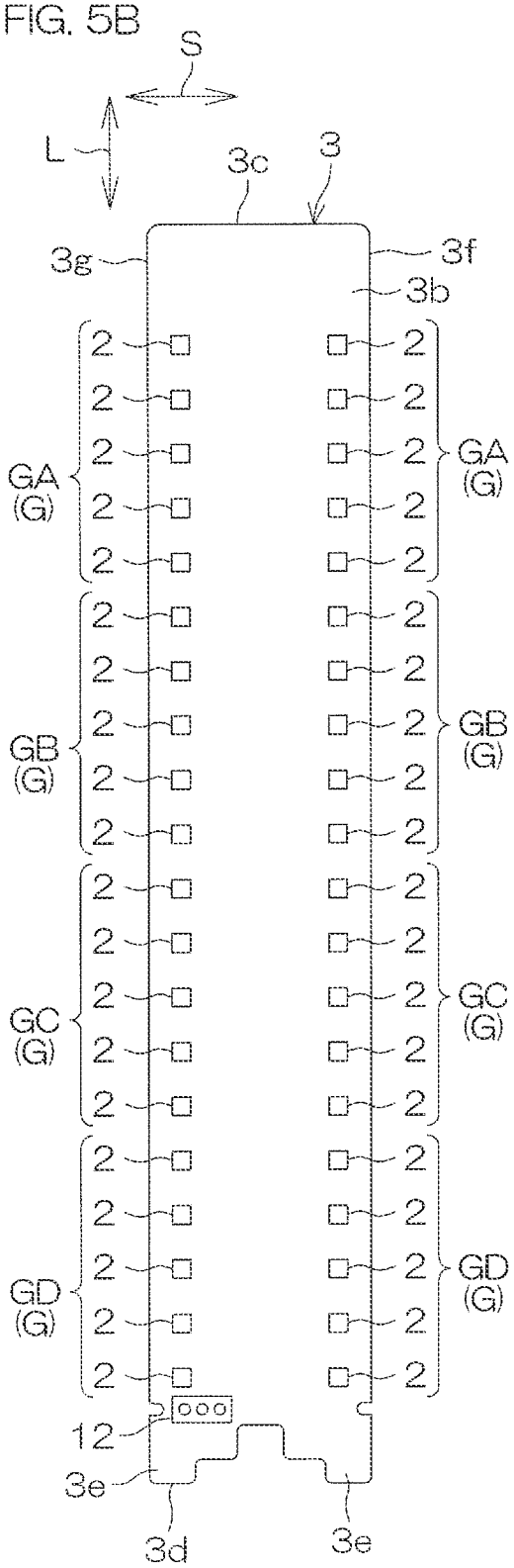
FIG. 5B is a rear view of the substrate.
Figure 6:
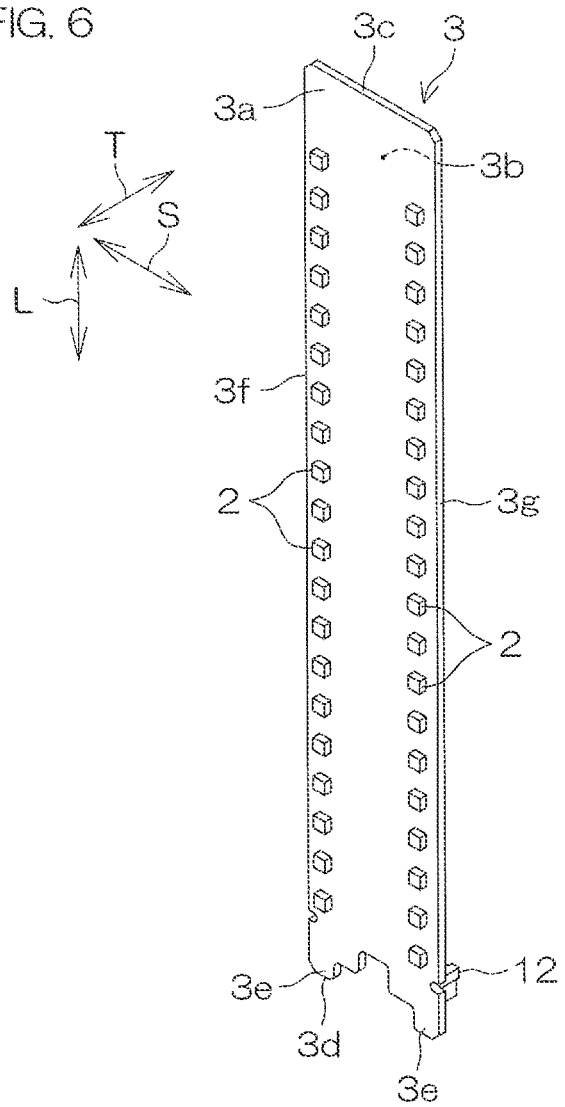
FIG. 6 is a perspective view of the substrate.
Figure 7:
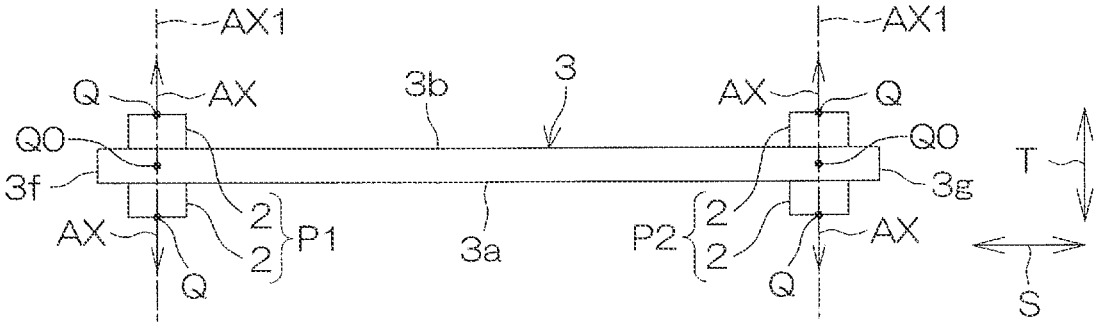
FIG. 7 is a schematic transverse cross-sectional view of the substrate.

FIG. 1 is a front view of a signal display lamp 1 according to a preferred embodiment of the present invention. FIG. 2 is a longitudinal cross-sectional view of the signal display lamp 1. FIG. 3 is an exploded view of the signal display lamp 1. FIG. 4 is an exploded perspective view of major components of the signal display lamp 1. FIG. 5A is a front view of a substrate 3 which is a component of the signal display lamp 1, and FIG. 5B is a rear view of the substrate 3. FIG. 6 is a perspective view of the substrate 3. FIG. 7 is a schematic transverse cross-sectional view of the substrate 3.

With reference to FIGS. 1 and 2, the signal display lamp 1 according to the preferred embodiment of the present invention is used in a manufacturing site, etc., of a factory and formed in a long and thin cylindrical shape. A posture of the signal display lamp 1 at the time of use can be arbitrarily set in accordance with use conditions. However, for the purpose of convenience, the description shall be given below based on the signal display lamp 1 disposed to be vertically long so that the up-down direction of the paper surface in each of FIGS. 1 to 6 aligns with the longitudinal direction of the signal display lamp 1. Specifically, in each of FIGS. 1 to 6, the description shall be given assuming that the upper side of the paper surface corresponds to the upper side of the signal display lamp 1 and the lower side of the paper surface corresponds to the lower side of the signal display lamp 1.

With reference to FIG. 3, the signal display lamp 1 includes the substrate 3 on which LEDs 2 serving as light sources are mounted, lens components 4, a body 5, a plate 6, a head cover 7, an outer top 8, a waterproof cap 9, and an outer case 10. Hereinafter, each of the parts shall be described individually.

As shown in FIGS. 2 to 4, the outer case 10 is formed in a long cylindrical shape and disposed to contain the lens components 4. The outer case 10 is made of, for example, a semi-transparent material and transmits light from the LEDs 2 via the lens components 4 to a periphery. A lens cut portion is not formed in the outer case 10. The outer case 10 includes an upper end portion 10*a*, a lower end portion 10*b*, and an intermediate portion 10*c* serving as a main body portion disposed between the upper end portion 10*a* and the lower end portion 10*b*.

The head cover 7 is a cylindrical container which is open on the lower side. The outer top 8 is a cylindrical member coupled to the head cover 7 and the outer case 10.

The outer top 8 has a support groove 8*d* (see FIG. 2) that fits and supports an upper end edge (first end edge 3*c*) of the substrate 3.

The waterproof cap 9 is contained in the outer top 8. The waterproof cap 9 is a ring-shaped packing made of rubber, etc., and seals a portion between an inner peripheral portion of the outer top 8 and an outer peripheral portion of the upper end portion 10*a* of the outer case 10 (see FIG. 2).

The body 5 is formed in a cylindrical shape which is open on the upper side and includes a bottom wall 5*a* and a peripheral side wall 5*b*.

The plate 6 is a disc-shaped member which is received by an inner peripheral step portion 5*e* (see FIG. 2) of the peripheral side wall 5*b* of the body 5. As shown in FIGS. 2 to 4, a pair of block-shaped support portions 6*b* that support a lower end edge of the substrate 3 are attached to an upper surface 6*a* of the plate 6. Each of the support portions 6*b* forms a fitting groove 6*c* to which a corresponding supported projection 3*e* of the substrate 3 is inserted, fitted, and held.

Next, the substrate 3 shall be described.

As shown in FIGS. 5A, 5B, and 6, the substrate 3 is formed in a substantially-oblong and thin plate shape with the up-down direction as the longitudinal direction L and the horizontal direction as the short direction S. A direction orthogonal to the longitudinal direction L and the short direction S is a thickness direction T of the substrate 3. The substrate 3 has a front surface 3*a* and a rear surface 3*b* serving as both side surfaces in the thickness direction T. A size of the substrate 3 in the longitudinal direction L is slightly smaller than a longitudinal size of the signal display lamp 1 (see FIG. 2).

The substrate 3 also has the first end edge 3*c* and a second end edge 3*d* of the longitudinal direction L. The first end edge 3*c* corresponds to the upper end edge and the second end edge 3*d* corresponds to the lower end edge. The pair of supported projections 3*e* projecting downward are provided in the second end edge 3*d* of the longitudinal direction L. Each of the supported projections 3*e* is supported by the support portion 6*b* of the plate 6.

The substrate 3 has a first end edge 3*f* and a second end edge 3*g* of the short direction S.

On each of the front surface 3*a* and the rear surface 3*b*, the LEDs (light emitting diodes) 2 serving as the light sources are mounted at positions respectively close to the first end edge 3*f* and the second end edge 3*g* of the short direction S. The LEDs 2 mounted on the front surface 3*a* and the LEDs 2 mounted on the rear surface 3*b* are placed at the same positions in the short direction S (see FIG. 7).

On each of the front surface 3*a* and the rear surface 3*b*, the plurality of LEDs 2 are mounted and aligned in two rows along the longitudinal direction L. Specifically, in each of the rows, five LEDs 2 aligned at equal intervals along the longitudinal direction L form a single group GA, GB, GC, GD in order from the top (simply referred to as the groups G when referred to collectively) and the four groups G are aligned at equal intervals along the longitudinal direction L. That is, in the substrate 3, the plurality of pairs of LEDs 2 are mounted at predetermined intervals in the longitudinal direction L. The individual LED 2 is formed in a small piece shape. In each row of each group G, the single LED 2 is disposed on the front surface 3*a* and the single LED 2 is disposed on the rear surface 3*b* at the same positions in the longitudinal direction L.

Specifically, as shown in FIG. 7, at the positions of the longitudinal direction L, the LEDs 2 disposed on the front surface 3*a* and the rear surface 3*b* at the positions close to the first end edge 3*f* of the short direction S form a first pair P1. The LEDs 2 forming the first pair P1 share optical axes AX with each other and emit light in directions directly opposite to each other.

At the respective positions of the longitudinal direction L, the LEDs 2 disposed on the front surface 3*a* and the rear surface 3*b* at the positions close to the second end edge 3*g* of the short direction S form a second pair P2. Optical axes AX of the LEDs 2 forming the second pair P2 are disposed on the same optical axis line AX1 and the LEDs 2 emit light in directions directly opposite to each other.

Each of the light sources (LEDs 2) is disposed at a light source position Q of the lens component. A central position Q0 between a pair of light source positions Q at which the light sources (LEDs 2) forming the first pair P1 are disposed corresponds to a central position in the thickness direction T of the substrate 3 (central position between the front surface 3*a* and the rear surface 3*b*). Similarly, a central position Q0 between a pair of light source positions Q at which the light sources (LEDs 2) forming the second pair P2 are disposed corresponds to a central position in the thickness direction T of the substrate 3 (central position between the front surface 3*a* and the rear surface 3*b*).

At a position close to the second end edge 3*d* (lower end edge) of the longitudinal direction L, a terminal 12 is mounted on the rear surface 3*b*. A cable (not shown) that supplies control signals and electric power is connected to the terminal 12. The terminal 12 and the LEDs 2 are electrically connected. Each of the LEDs 2 emits light upon supply of the control signals and the electric power from the cable via the terminal 12.

Figure 8A:
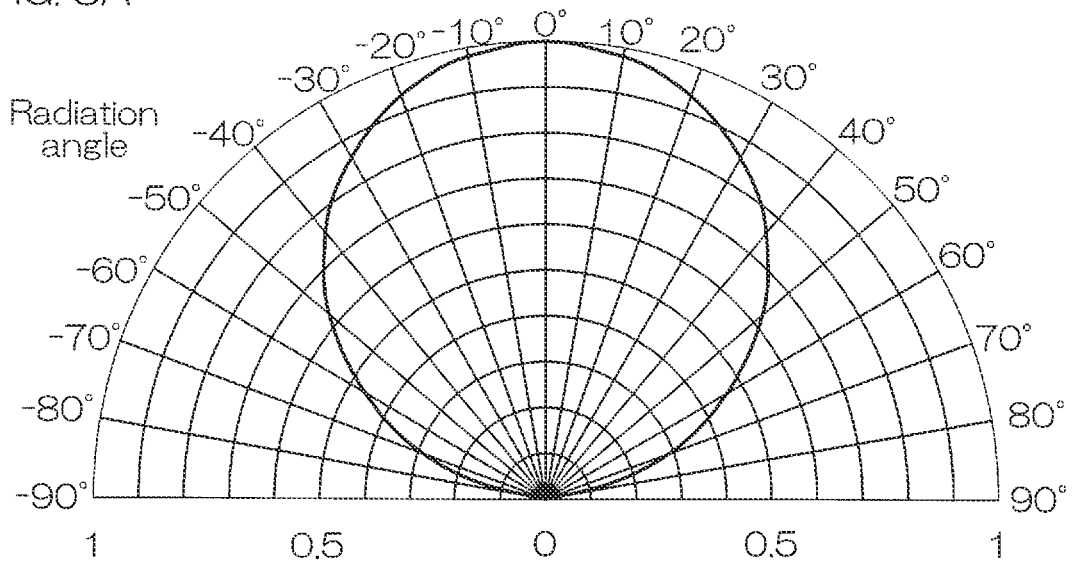
FIGS. 8A and 8B are characteristic diagrams showing examples of a light distribution characteristic of LEDs as light sources.

FIG. 8A is a characteristic diagram showing an example of a light distribution characteristic of the light sources (LEDs 2) applicable to the lens components 4. Luminosity is the highest in a direction along the optical axis (direction with which a radiation angle is 0°), the luminosity monotonously becomes smaller with an increase in distance away from the optical axis, and the luminosity is substantially zero in directions orthogonal to the direction along the optical axis (direction with which the radiation angle is 0°) (directions with which the radiation angles are 90° and −90°).

Figure 8B:
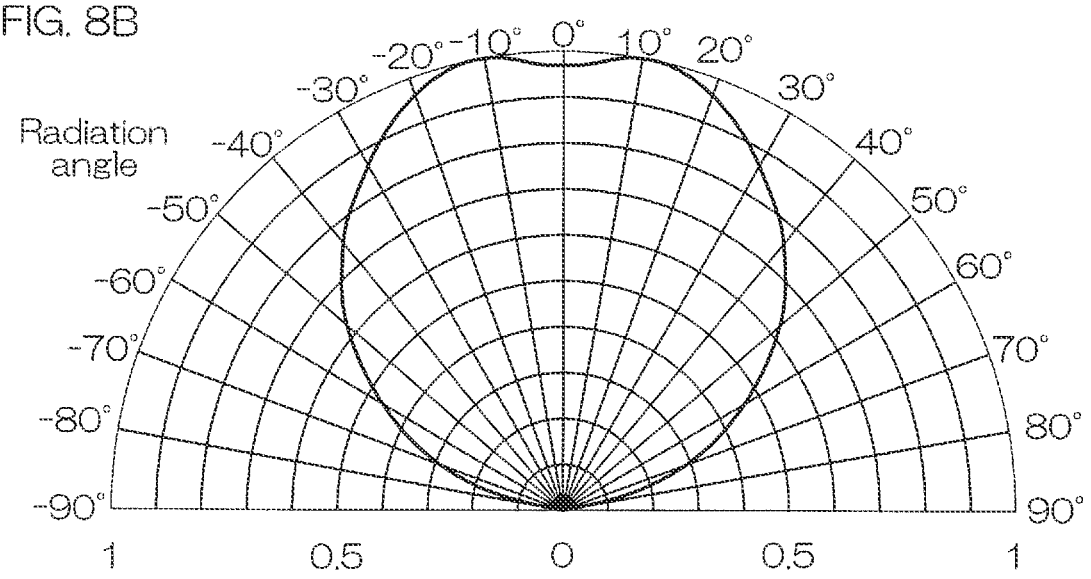

As another example of the light sources (LEDs 2) which are applicable to the lens components 4, as shown in FIG. 8B, it is possible to use light sources having the highest luminosity in a direction which makes a certain angle with the direction along the optical axis (direction with which the radiation angle is 0°).

Next, the lens components 4 shall be described.

With reference to FIG. 2, the same number of lens components 4 as the groups G of the LEDs 2 described above (that is, four lens components 4) are provided and modes (a shape and a size) of each of the lens components 4 are the same. These four lens components 4 are used upon being coupled in the up-down direction (longitudinal direction L of the substrate 3). That is, the individual lens component 4 is used upon being coupled to another lens component 4 of the same mode in the longitudinal direction L and the plurality of (four) lens components 4 are continuously provided in the signal display lamp 1.

When referring to the four lens components 4 distinctively as a lens component 4A, a lens component 4B, a lens component 4C, and a lens component 4D in order from the top, the lens components 4A, 4B, 4C, and 4D respectively correspond to the groups GA, GB, GC, and GD of the LEDs 2.

The lens components 4 have the same mode as each other but may be colored with different colors from each other. Alternatively, while the lens components 4 have the same color as each other, emission color of the LEDs 2 that emit light toward the lens components 4 may be different for each of the lens components 4. Further, in each of the lens components 4, actions of turning on and then turning off the five LEDs 2 aligned in the longitudinal direction L successively from the top or from the bottom, for example, may be repeated.

Figure 9A:
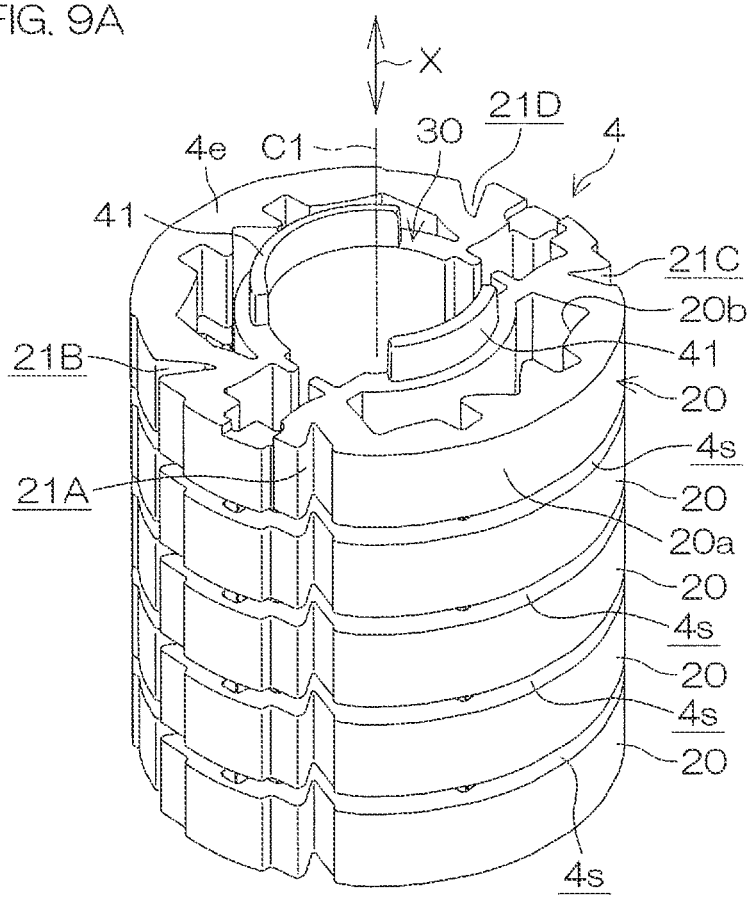
FIGS. 9A and 9B are a perspective view and a side view of a lens component.
Figure 9B:
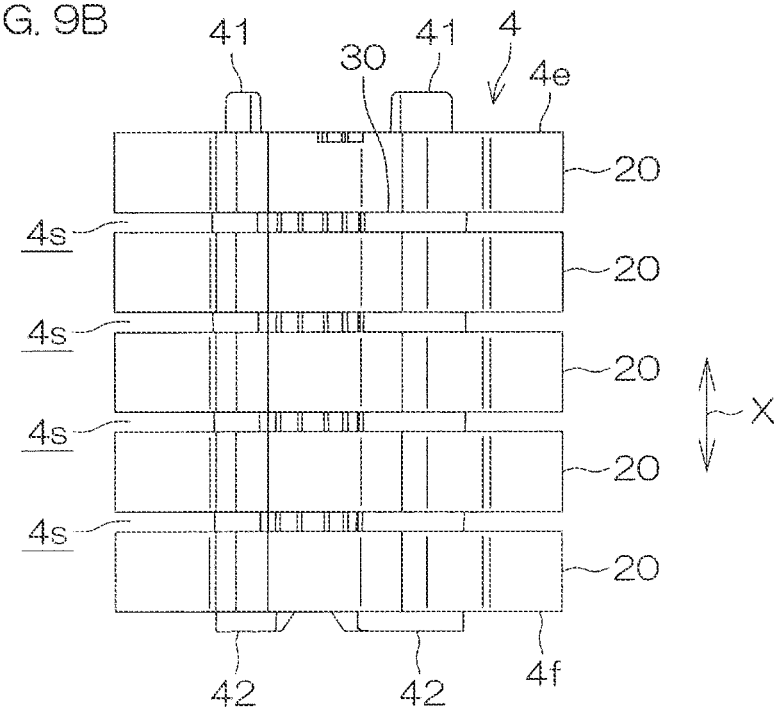
Figure 10A:
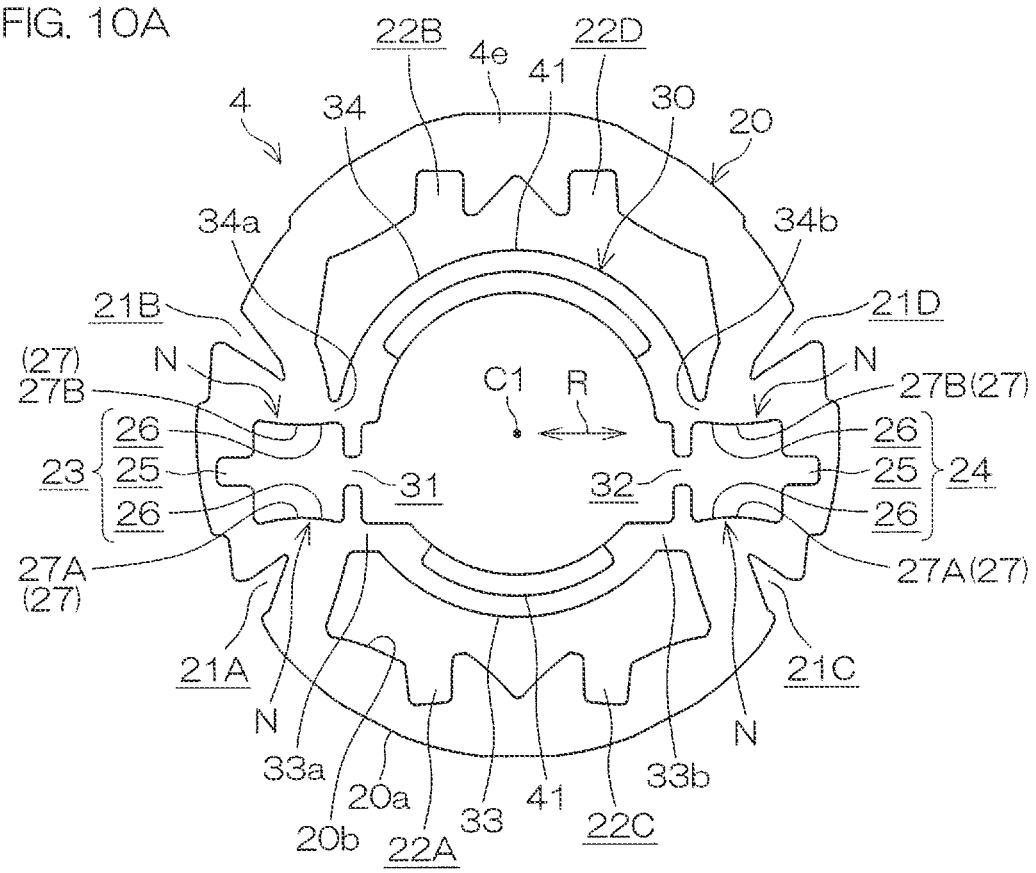
FIGS. 10A and 10B are a plan view and a bottom view of the lens component.
Figure 10B:
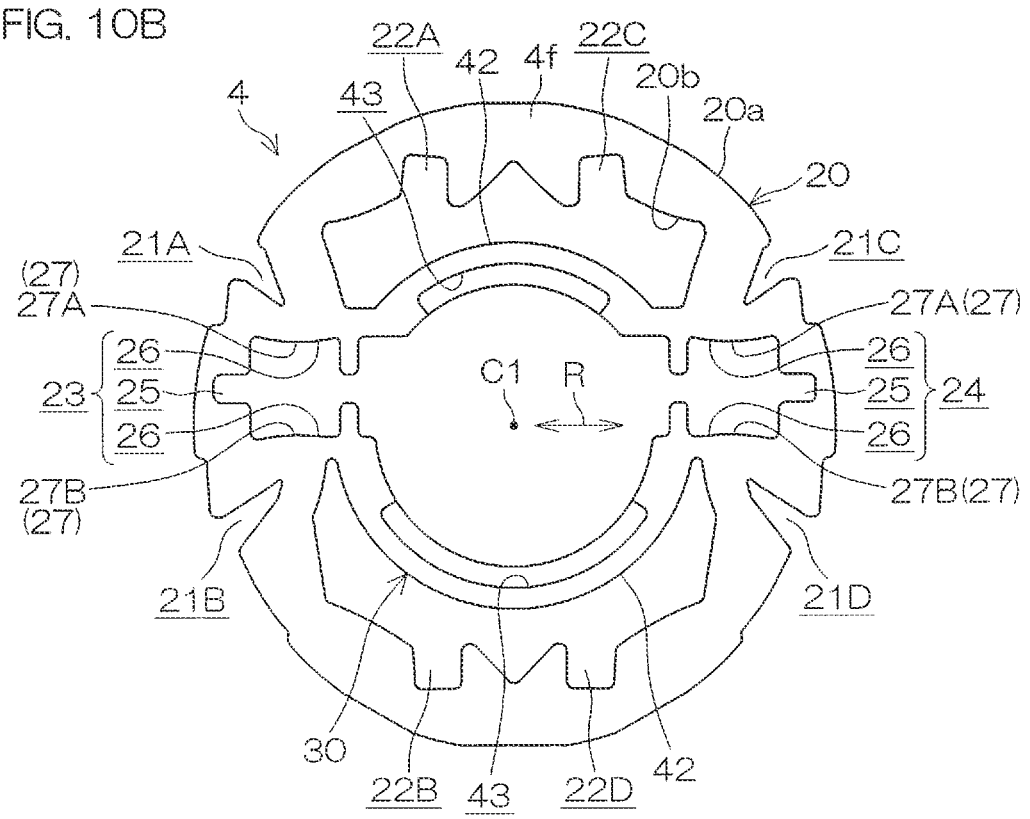
Figure 11:
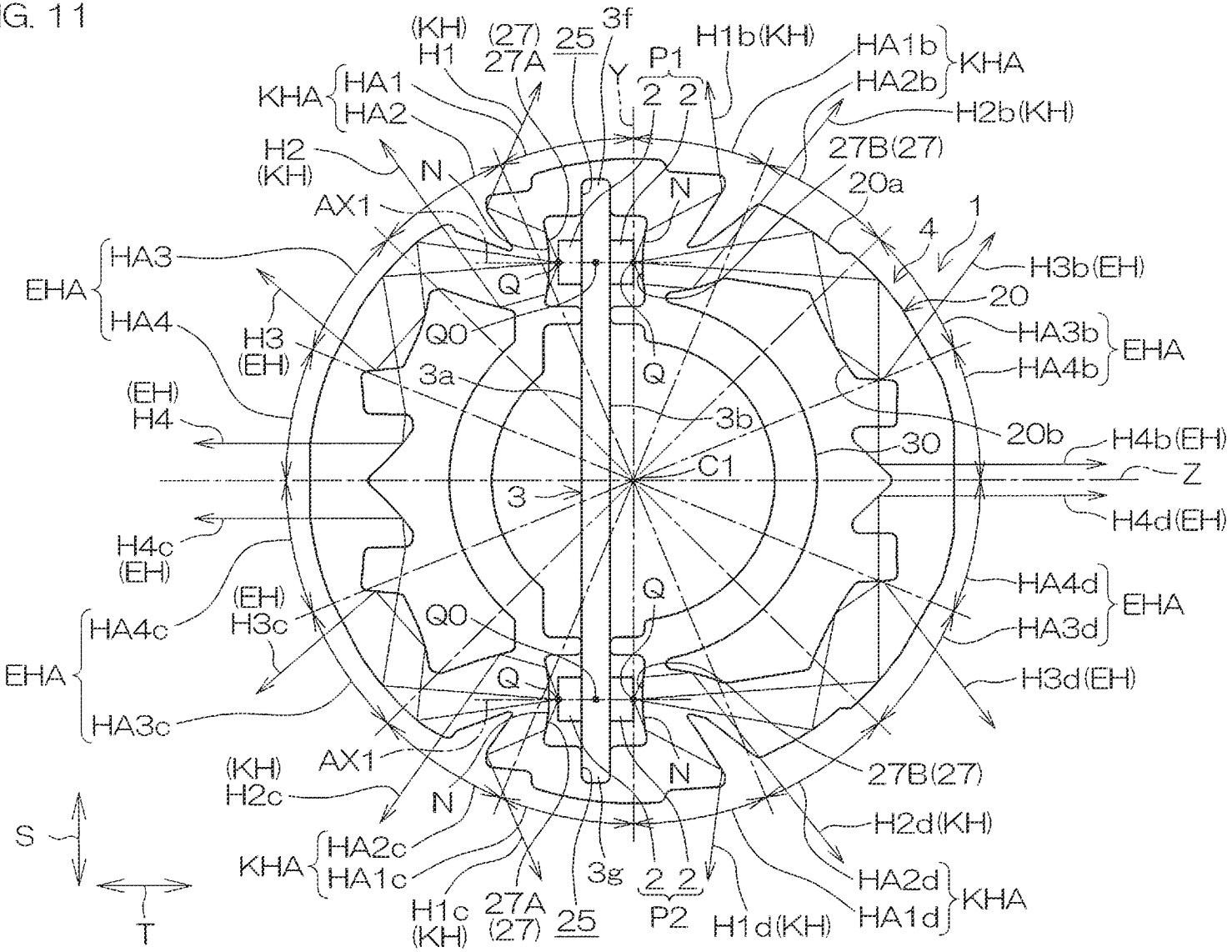
FIG. 11 is a schematic cross-sectional view of the lens component that contains the substrate.
Figure 12:
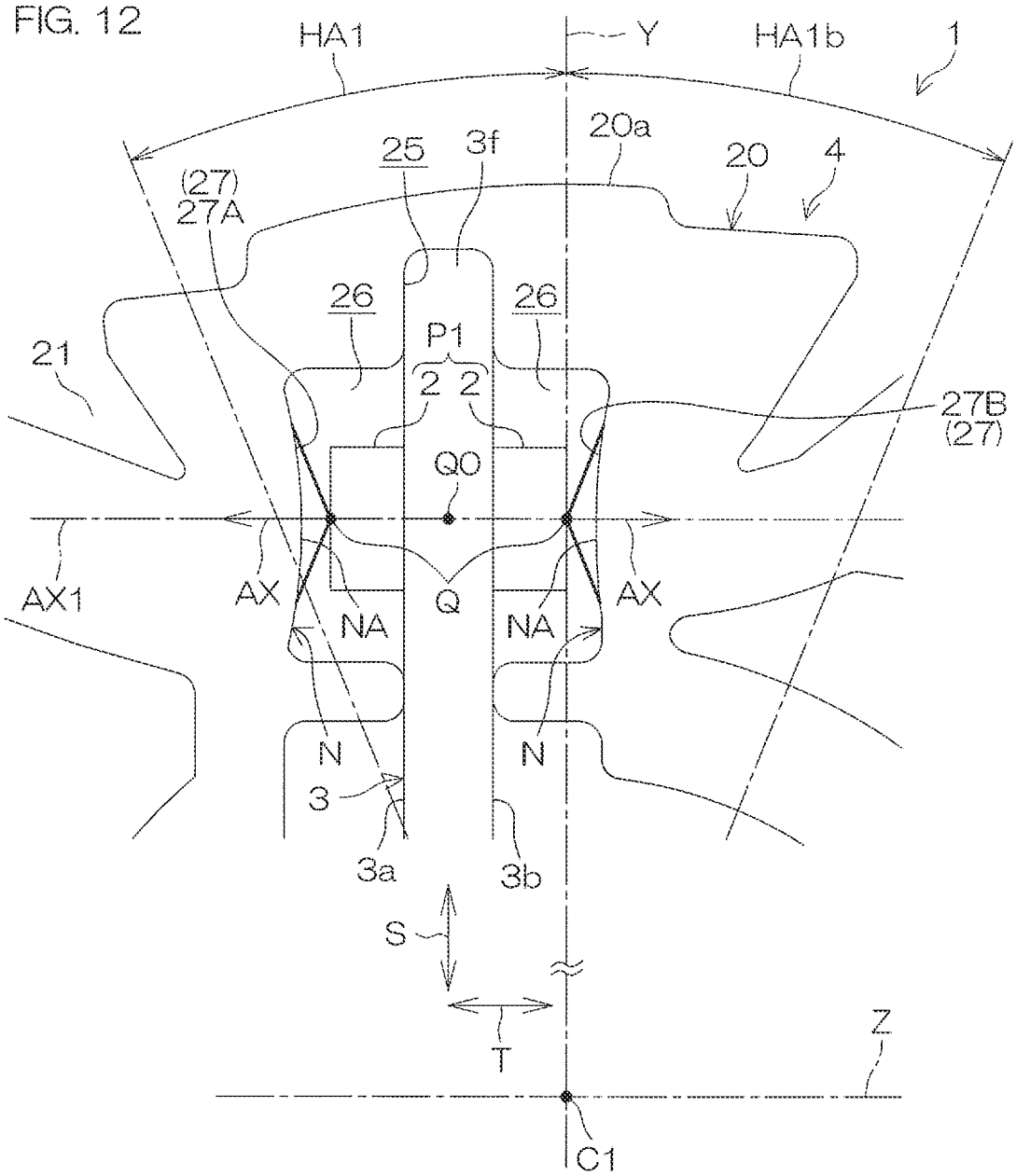
FIG. 12 is an explanatory view for explaining an irradiation range of the LEDs with respect to an incidence portion, and is the schematic view in which part of FIG. 11 is enlarged.
Figure 13A:
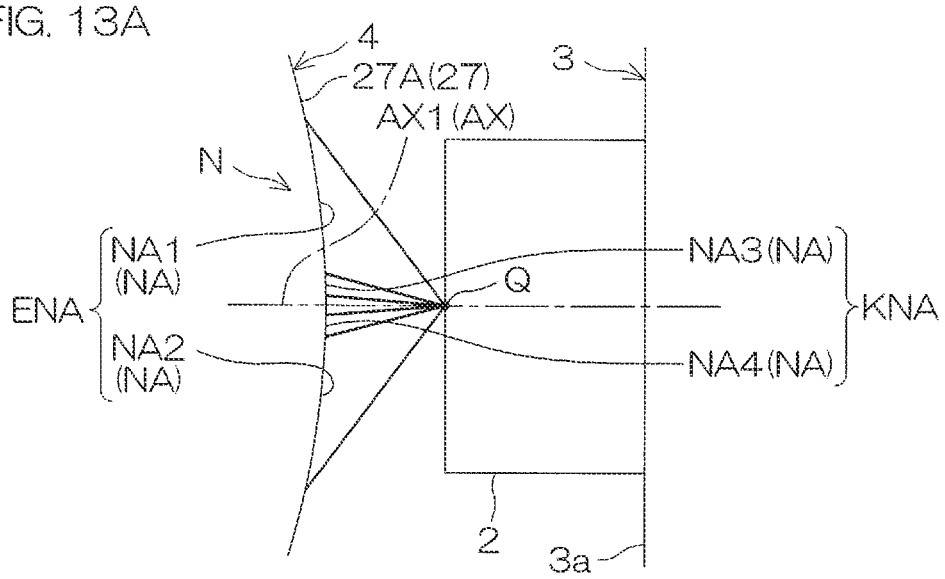
FIGS. 13A and 13B are explanatory views for explaining incidence regions of a light incidence portion with respect to the LED which is one or the other of a first pair of light sources.
Figure 13B:
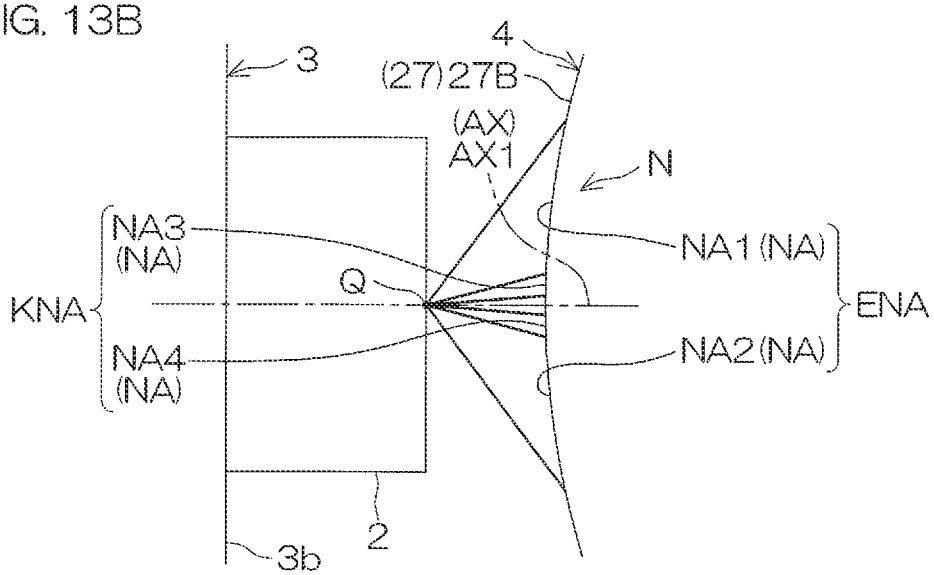

FIG. 9A is a perspective view of the lens component 4. FIG. 9B is a side view of the lens component 4. FIG. 10A is a plan view of the lens component 4. FIG. 10B is a bottom view of the lens component 4. FIG. 11 is a schematic cross-sectional view of the lens component that contains the substrate. FIG. 12 is an explanatory view for explaining an irradiation range of the LEDs 2 with respect to an incidence portion, and is the schematic view in which part of FIG. 11 is enlarged. FIG. 13A is an explanatory view for explaining incidence regions of a light incidence portion with respect to the LED 2 which is one of the first pair P1 of LEDs 2. FIG. 13B is an explanatory view for explaining incidence regions of a light incidence portion with respect to the other LED 2 of the first pair P1 of LEDs 2.

Hereinafter, the lens component 4 shall be described with reference to FIGS. 9 to 13B.

The lens component 4 is formed in a substantially cylindrical shape. The entire lens component 4 is made of transparent (including semi-transparent and colored-transparent and the same applies hereinafter) resin and molded by using a mold by injection molding, etc. Respective parts of the lens component 4 (to be described below) are integrated. The resin described above includes acryl resin.

The lens component 4 mainly includes an upper surface 4*e*, a lower surface 4*f*, plurality of stages of, for example, five stages of light guiding radiation portions 20 vertically aligned, a coupling structure portion 30 that couples the light guiding radiation portions 20 together, first coupling portions 41, and second coupling portions 42. The upper surface 4*e* of the lens component 4 is an upper surface of the uppermost light guiding radiation portion 20. The lower surface 4*f* of the lens component 4 is a lower surface of the lowermost light guiding radiation portion 20.

Each of the light guiding radiation portions 20 has a central axis line C1 and is formed in a cylindrical shape which is short in the up-down direction. A gap 4*s* of a predetermined interval is provided between the light guiding radiation portions 20 adjacent to each other in the up-down direction.

The vertically-aligned light guiding radiation portions 20 respectively correspond to the vertically-aligned LEDs 2 (in the longitudinal direction L of the substrate 3) in the groups G of the LEDs 2 (see FIGS. 5A and 5B). Specifically, the four LEDs 2 disposed at the same up and down positions (height positions) as each of the light guiding radiation portions 20 (see FIGS. 7 and 11) correspond to the light guiding radiation portion 20.

The light guiding radiation portion 20 includes an outer peripheral portion 20*a*, an inner peripheral portion 20*b*, four outside axial grooves 21A, 21B, 21C, 21D formed in the outer peripheral portion 20*a*, four inside axial grooves 22A, 22B, 22C, 22D formed in the inner peripheral portion 20*b*, a first slit portion 23, and a second slit portion 24.

The outer peripheral portion 20*a* is formed by a substantially cylindrical surface centered on the central axis line C1. Specifically, the outer peripheral portion 20*a* includes a part formed by a cylindrical surface and a part formed by a curved surface or a flat surface which closely resembles to the cylindrical surface. The inner peripheral portion 20*b* includes a part formed by a cylindrical surface centered on the central axis line C1 and a part of a recessed groove or a projected line undulating in the radial direction and extending in the axial direction.

The first slit portion 23 and the second slit portion 24 are grooves formed in the inner peripheral portion 20*b*, extending in an axial direction X and having groove bottoms close to the outer peripheral portion 20*a* side. The first slit portion 23 and the second slit portion 24 are formed to oppose each other in a direction parallel to a radial direction R.

Each of the first slit portion 23 and the second slit portion 24 includes a holding groove 25 and a pair of light source housing recessed portions 26. The holding groove 25 of the first slit portion 23 and the holding groove 25 of the second slit portion 24 are disposed on the groove bottom side of the slit portions 23, 24, and respectively hold the first end edge 3*f* and the second end edge 3*g* of the short direction S of the substrate 3.

The light source housing recessed portions 26 of the first slit portion 23 and the second slit portion 24 are disposed adjacent to the holding grooves 25 of the slit portions 23, 24 on the central axis line C1 side. Each of the light source housing recessed portions 26 is recessed portions formed on a pair of inner side surfaces of the corresponding slit portion 23, 24. The LEDs 2 serving as the corresponding light sources are housed in the pair of light source housing recessed portions 26 of each of the slit portions 23, 24.

A pair of incidence surfaces 27 constituting light incidence portions N are formed by bottoms of the pair of light source housing recessed portions 26 of each of the slit portions 23, 24. One of the pair of incidence surfaces 27 (on the left side in FIG. 11) shall be referred to as an incidence surface 27A and the other incidence surface (on the right side in FIG. 11) shall be referred to as an incidence surface 27B. These incidence surfaces 27 are disposed to oppose each other across the corresponding slit portion 23, 24. These incidence surfaces 27 may be flat surfaces extending in parallel, or may expand in a substantially arc shape in directions approaching each other as shown in FIGS. 11 and 12. That is, convex lens surfaces projecting toward the corresponding LED 2 side may be formed on the incidence surfaces 27. It is possible to collect and make the light incident from the LEDs 2 on the incidence surfaces 27 formed by the convex lens surfaces.

The coupling structure portion 30 is a cylindrical member in which a first slit portion 31 and a second slit portion 32 extending in the axial direction X are formed. The coupling structure portion 30 and the light guiding radiation portion 20 share the central axis line C1. That is, the coupling structure portion 30 is concentric to the light guiding radiation portion 20 and has a smaller diameter than the light guiding radiation portion 20.

The first slit portion 31 of the coupling structure portion 30 communicates with the first slit portion 23 of the light guiding radiation portion 20. The second slit portion 32 of the coupling structure portion 30 communicates with the second slit portion 24 of the light guiding radiation portion 20. The coupling structure portion 30 is constituted of a first C-shaped member 33 and a second C-shaped member 34 divided by both the slit portions 31, 32.

The first C-shaped member 33 includes coupling portions 33*a*, 33*b* coupled to the light guiding radiation portions 20 at each stage at both circumferential ends. The second C-shaped member 34 includes coupling portions 34*a*, 34*b* coupled to the light guiding radiation portions 20 at both circumferential ends. By actions of the coupling portions 33*a*, 33*b*; 34*a*, 34*b* of both the C-shaped members 33, 34, the vertical five stages of the light guiding radiation portions 20 are coupled to each other.

Inner side surfaces of the slit portions 31, 32 of the coupling structure portion 30 oppose each other across the substrate 3 and have a function of regulating a position of the substrate 3.

As shown in FIGS. 9 and 10A, the first coupling portions 41 are a pair of fitting projections formed in an upper end of the coupling structure portion 30 to project from the upper surface 4*e* of the lens component 4. Each of the fitting projections serving as the first coupling portions 41 is an arc-shaped projection concentric to the corresponding C-shaped member 33, 34.

On the other hand, as shown in FIG. 10B, the second coupling portions 42 are a pair of projections formed in a lower end of the coupling structure portion 30 so as to project from the lower surface 4*f* of the lens component 4. Each of the projections serving as the second coupling portions 42 is an arc-shaped projection concentric to the corresponding C-shaped member 33, 34, and a fitting groove 43 to which each of the first coupling portions 41 of the corresponding lens component 4 is respectively fitted is formed in an inner peripheral portion.

By fitting the fitting projections serving as the first coupling portions 41 and the fitting grooves 43 of the corresponding second coupling portions 42 to each other between the corresponding lens components 4, the corresponding lens components 4 are coupled so that relative displacements in the radial direction, the axial direction, and the circumferential direction are regulated.

As shown in FIG. 11, the light guiding radiation portion 20 has a first axis line Y and a second axis line Z which are orthogonal to the central axis line C1 and orthogonal to each other. When viewed from a direction of the central axis line C1, as shown in FIG. 12, the LEDs 2 mounted on the substrate 3 which is held by the holding groove 25 of the light guiding radiation portion 20 are disposed at the predetermined light source positions Q separated from the second axis line Z in a direction of the first axis line Y by aligning its optical axis AX with the optical axis line AX1 which is parallel to the second axis line Z. As shown in FIG. 11, the light guiding radiation portion 20 guides the light from the LEDs 2 and radiates the light radially in a direction away from the central axis line C1 toward a periphery of the central axis line C1.

In the present preferred embodiment, when viewed from the direction of the central axis line C1, the central position Q0 between the light source positions Q of the light sources (LEDs 2) forming the first pair P1 (central position in the thickness direction T of the substrate 3) is disposed so as to offset from the first axis line Y in a direction parallel to the second axis line Z (on the left side in FIG. 11). That is, the substrate 3 is disposed so as to offset in a direction of the second axis line Z with respect to the central axis line C1.

The light guiding radiation portion 20 includes the light incidence portions N having the incidence surfaces 27 (27A, 27B) and a plurality of radiation mechanisms H1, H2, H3, H4; H1*b*, H2*b*, H3*b*, H4*b*; H1*c*, H2*c*, H3*c*, H4*c*; H1*d*, H2*d*, H3*d*, H4*d* (simply referred to as the radiation mechanisms H when referred to collectively). The plurality of radiation mechanisms H guide the light that is made incident from the light incidence portions and respectively radiate to a plurality of radiation angle ranges HA1, HA2, HA3, HA4; HA1*b*, HA2*b*, HA3*b*, HA4*b*; HA1*c*, HA2*c*, HA3*c*, HA4*c*; HA1*d*, HA2*d*, HA3*d*, HA4*d* (simply referred to as the radiation angle ranges HA when referred to collectively) defined by a plurality of central angles centered on the central axis line C1.

As shown in FIGS. 13A and 13B, each of the incidence surfaces 27A, 27B (27) includes a plurality of incidence regions NA which collects the light from the LEDs 2 disposed at the light source positions Q and respectively makes the light incident on the plurality of radiation mechanisms H. The plurality of incidence regions NA includes a close side incidence region KNA close to the optical axis line AX1 and a distant side incidence region ENA disposed farther from the optical axis line AX1 than the close side incidence region KNA.

When viewed from the direction of the central axis line C1, the plurality of radiation angle ranges HA include a close side radiation angle range KHA closer to the first axis line Y than the second axis line Z and a distant side radiation angle range EHA farther from the first axis line Y and closer to the second axis line Z than the close side radiation angle range KHA. When viewed from the direction of the central axis line C1, a border between the close side radiation angle range KHA and the distant side radiation angle range EHA is a line passing through the central axis line C1 and making an angle of 45 degrees with respect to the first axis line Y and the second axis line Z.

The light that is made incident on the close side incidence region KNA in FIGS. 13A and 13B is radiated to the distant side radiation angle range EHA in FIG. 11 via the corresponding radiation mechanism H. The light that is made incident on the distant side incidence region ENA in FIGS. 13A and 13B is radiated to the close side radiation angle range KHA in FIG. 11 via the corresponding radiation mechanism H.

Specifically, as shown in FIGS. 13A and 13B, the distant side incidence region ENA includes first and second incidence regions NA1 and NA2 disposed on opposite sides to each other with respect to the optical axis line AX1. The close side incidence region KNA includes a third incidence region NA3 disposed between the first incidence region NA1 and the optical axis line AX1 and a fourth incidence region NA4 disposed between the second incidence region NA2 and the optical axis line AX1.

Each of the first incidence region NA1 and the second incidence region NA2 serving as the distant side incidence region ENA is set within a wider angle range than each of the third incidence region NA3 and the fourth incidence region NA4 serving as the close side incidence region KNA.

First, arrangements and functions of the light guiding radiation portion 20 in a range of 90° on the upper side with respect to the second axis line Z (on the light source side of the first pair P1) and on the left side of the first axis line Y (on the incidence surface 27A side) when viewed from the direction of the central axis line C1 as shown in FIG. 11 shall be described.

When viewed from the direction of the central axis line C1, the close side radiation angle range KHA includes the first radiation angle range HA1 adjacent to the first axis line Y and the second radiation angle range HA2 adjacent to the opposite side of the first axis line Y with respect to the first radiation angle range HA1. The mechanism that radiates the light to the close side radiation angle range KHA is a close side radiation mechanism KH. The close side radiation mechanism KH includes the first radiation mechanism H1 that radiates the light to the first radiation angle range HA1 and the second radiation mechanism H2 that radiates the light to the second radiation angle range HA2.

When viewed from the direction of the central axis line C1, the distant side radiation angle range EHA includes the third radiation angle range HA3 adjacent to the opposite side of the first radiation angle range HA1 with respect to the second radiation angle range HA2 and the fourth radiation angle range HA4 adjacent to the third radiation angle range HA3 with respect to the second axis line Z. The mechanism that radiates the light to the distant side radiation angle range EHA is a distant side radiation mechanism EH. The distant side radiation mechanism EH includes the third radiation mechanism H3 that radiates the light to the third radiation angle range HA3 and the fourth radiation mechanism H4 that radiates the light to the fourth radiation angle range HA4.

The incident light from the first incidence region NA1, the second incidence region NA2, the third incidence region NA3, and the fourth incidence region NA4 (see FIGS. 13A and 13B) is guided via the corresponding radiation mechanisms H and respectively radiated to the first radiation angle range HA1, the second radiation angle range HA2, the third radiation angle range HA3, and the fourth radiation angle range HA4.

That is, the incident light from the first incidence region NA1 is guided via the first radiation mechanism H1 and radiated to the first radiation angle range HA1. The incident light from the second incidence region NA2 is guided via the second radiation mechanism H2 and radiated to the second radiation angle range HA2. The incident light from the third incidence region NA3 is guided via the third radiation mechanism H3 and radiated to the third radiation angle range HA3. The incident light from the fourth incidence region NA4 is guided via the fourth radiation mechanism H4 and radiated to the fourth radiation angle range HA4.

An optical path length in the light guiding radiation portion 20 before the light that is made incident on the close side incidence region KNA is radiated to the distant side radiation angle range EHA via the corresponding radiation mechanism H is set longer than an optical path length in the light guiding radiation portion 20 before the light that is made incident on the distant side incidence region ENA is radiated to the close side radiation angle range KHA via the corresponding radiation mechanism H.

That is, for the distant side radiation angle range EHA with which the optical path length in the light guiding radiation portion 20 is relatively long, the light relatively far from the optical axis AX having relatively high luminosity is made incident and the close side incidence region KNA of a relatively narrow angle range corresponds thereto. For the close side radiation angle range KHA with which the optical path length in the light guiding radiation portion 20 is relatively short, the light relatively close to the optical axis AX having relatively low luminosity is made incident and the distant side incidence region ENA of a relatively wide angle range corresponds thereto. Thereby, it is possible to radiate the light to the close side radiation angle range KHA and the distant side radiation angle range EHA by a mutually equal amount of light. Specifically, the radiation mechanisms H1 to H4 respectively radiate the light by a mutually equal amount of light.

Figure 14A:
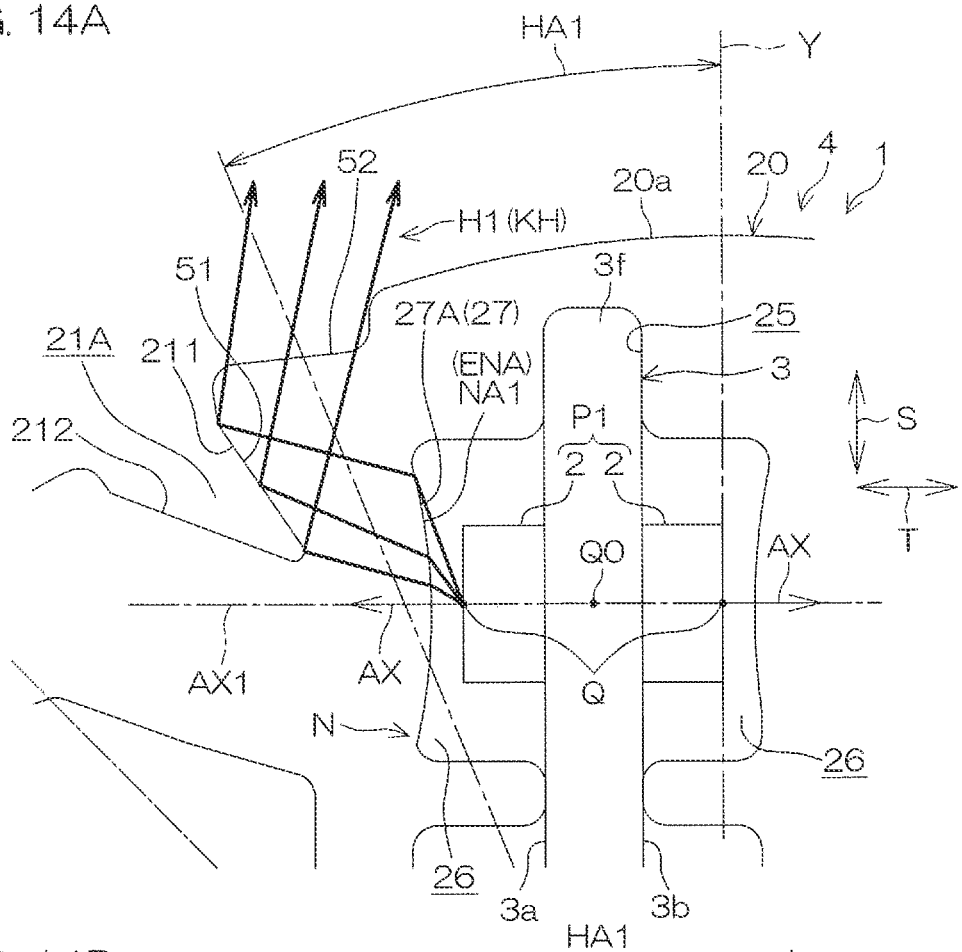
FIGS. 14A and 14B are enlarged cross-sectional views of major parts of the lens component, showing radiation characteristics of a first radiation mechanism and a second radiation mechanism on one side.

Next, with reference to FIG. 14A, the first radiation mechanism H1 serving as the close side radiation mechanism KH shall be described. As shown in FIG. 14A, the first radiation mechanism H1 includes a first reflection surface 51 and a first exit surface 52, and when viewed from the direction of the central axis line C1, radiates the light to the first radiation angle range HA1 serving as the close side radiation angle range KHA adjacent to the first axis line Y.

The outside axial groove 21A formed in the outer peripheral portion 20*a* of the light guiding radiation portion 20 has a substantially triangular cross-section. The outside axial groove 21A includes a first inner surface 211 opposing the rear side of the incidence surface 27A and a second inner surface 212 inclined and opposed to the first inner surface 211 as inner surfaces.

The first reflection surface 51 is an internal reflection surface along the first inner surface of the outside axial groove 21A. The first reflection surface 51 totally reflects the incident light from the first incidence region NA1 serving as the distant side incidence region ENA of the incidence surface 27A. The first exit surface 52 is provided in the outer peripheral portion 20*a*. The first exit surface 52 transmits and exits the reflected light from the first reflection surface 51 to the first radiation angle range HA1.

By the first radiation mechanism H1, the following advantages are obtained with respect to the prior art described above.

That is, in the prior art described above, the light that is made incident on the auxiliary lens portion for radiating to the side substantially orthogonal to the optical axis line is the direct irradiation light leaked out from the slit portion, and it is the light within a narrow irradiation range which is the farthest from the optical axis line. On the other hand, in the first radiation mechanism H1, the first reflection surface 51 is the internal reflection surface along the first inner surface 211 opposing the rear side of the incidence surface 27A among the inner surfaces of the outside axial groove 21A of the outer peripheral portion 20*a*. Therefore, it is possible to use the light over a wider irradiation range on the closer side to the optical axis line AX1 as compared to the prior art, and it is thus possible to increase the amount of light as compared to the prior art with respect to a direction substantially orthogonal to the optical axis line AX1.

The first reflection surface 51 is preferably a light collecting surface (such as a concave lens surface), and in a case where the first reflection surface 51 is a light collecting surface, it is possible to suppress diffusion of the light and improve visibility from the first radiation angle range HA1.

When viewed from the direction of the central axis line C1, the first reflection surface 51 is disposed within a range of a central angle that defines the second radiation angle range HA2 serving as a radiation angle range which is adjacent to the opposite side of the first axis line Y with respect to the first radiation angle range HA1. Thereby, by providing an appropriate distance between the LEDs 2 serving as the light sources and the first reflection surface 51, the degree of freedom of setting an area of the first reflection surface 51, inclination of the first exit surface 52 with respect to the optical axis AX, etc., is improved. Therefore, it is possible to guide the light over a wide irradiation range from the LEDs 2 serving as the light sources to the first reflection surface 51 and reflect to the first exit surface 52 side. Thus, it is possible to increase the amount of light of the first radiation angle range HA1 and improve visibility.

The first exit surface 52 preferably includes a refractive surface which refracts and emits the reflected light from the first reflection surface 51 such as to lead the reflected light to the central side of the first radiation angle range HA1. In that case, it is possible to improve visibility of the first radiation angle range HA1.

Figure 14B:
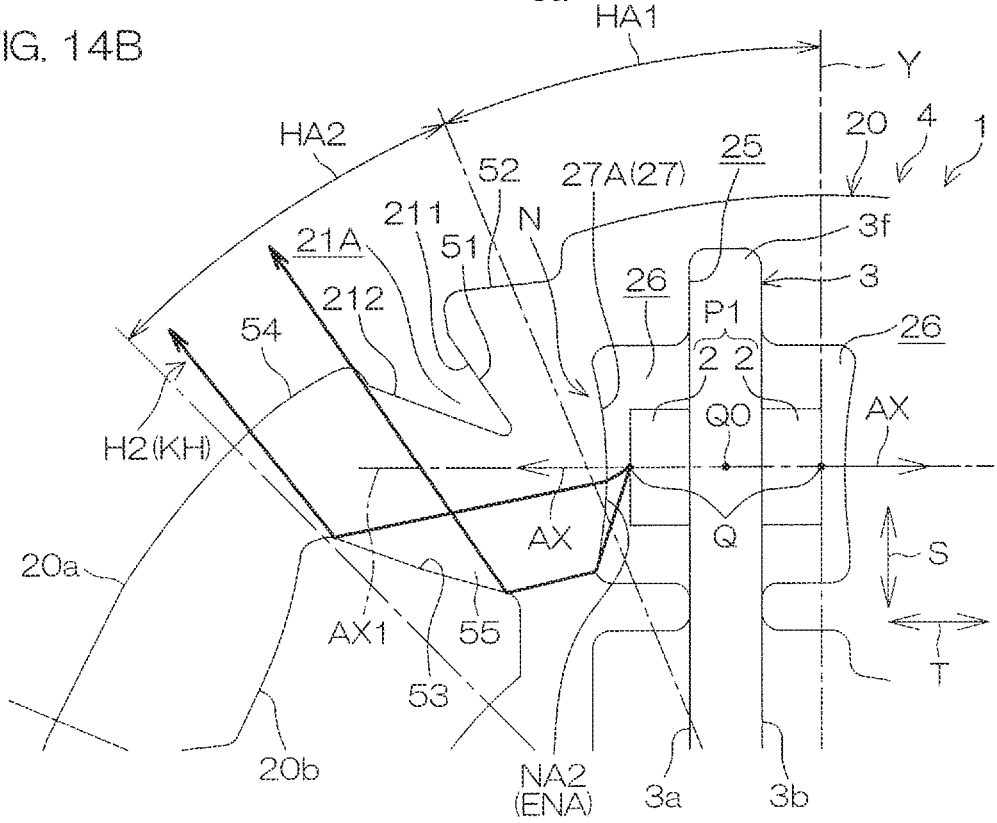

Next, with reference to FIG. 14B, the second radiation mechanism H2 serving as the close side radiation mechanism KH shall be described. As shown in FIG. 14B, the second radiation mechanism H2 includes a second reflection surface 53 and a second exit surface 54, and when viewed from the direction of the central axis line C1, radiates the light to the second radiation angle range HA2 serving as the close side radiation angle range adjacent to the opposite side of the first axis line Y with respect to the first radiation angle range HA1.

The second reflection surface 53 is an internal reflection surface along the inner peripheral portion 20*b* of the light guiding radiation portion 20 and totally reflects the incident light from the second incidence region NA2 serving as the distant side incidence region of the incidence surface 27A. The second exit surface 54 is provided in the outer peripheral portion 20*a* of the light guiding radiation portion 20 and transmits and exits the reflected light from the second reflection surface 53 to the second radiation angle range HA2.

The second reflection surface 53 is preferably a light collecting surface (such as a concave lens surface), and in a case where the second reflection surface 53 is a light collecting surface, it is possible to suppress diffusion of the light and improve visibility from the second radiation angle range HA2.

The second reflection surface 53 is disposed within a range of a central angle that defines the second radiation angle range HA2. Thereby, in the second radiation mechanism H2, it is possible to reduce loss of light in the light guiding radiation portion 20 by shortening the optical path length in the light guiding radiation portion 20. Therefore, it is possible to increase the amount of light radiated to the second radiation angle range HA2 and improve visibility of the second radiation angle range HA2.

The second exit surface 54 preferably includes a refractive surface which refracts and emits the reflected light from the second reflection surface 53 such as to lead the reflected light to the central side of the second radiation angle range HA2. In that case, it is possible to improve visibility of the second radiation angle range HA2.

When viewed from the direction of the central axis line C1, the second reflection surface 53 is disposed on the rear side of the second inner surface 212 serving as the inner surface of the outside axial groove 21A and inclined and opposed to the first inner surface 211. Between the second inner surface 212 and the second reflection surface 53, a light guiding plate portion 55 connecting the incidence surface 27A (light incidence portion) of the light guiding radiation portion 20 and the outer peripheral portion 20*a* is formed.

In the light guiding radiation portion 20, it is possible to use the light guiding plate portion 55 formed between the second inner surface 212 of the outside axial groove 21A of the outer peripheral portion 20*a* and the second reflection surface 53 for light guiding from the incidence surface 27A (light incidence portion) to the outer peripheral portion 20*a* side.

Figure 15A:
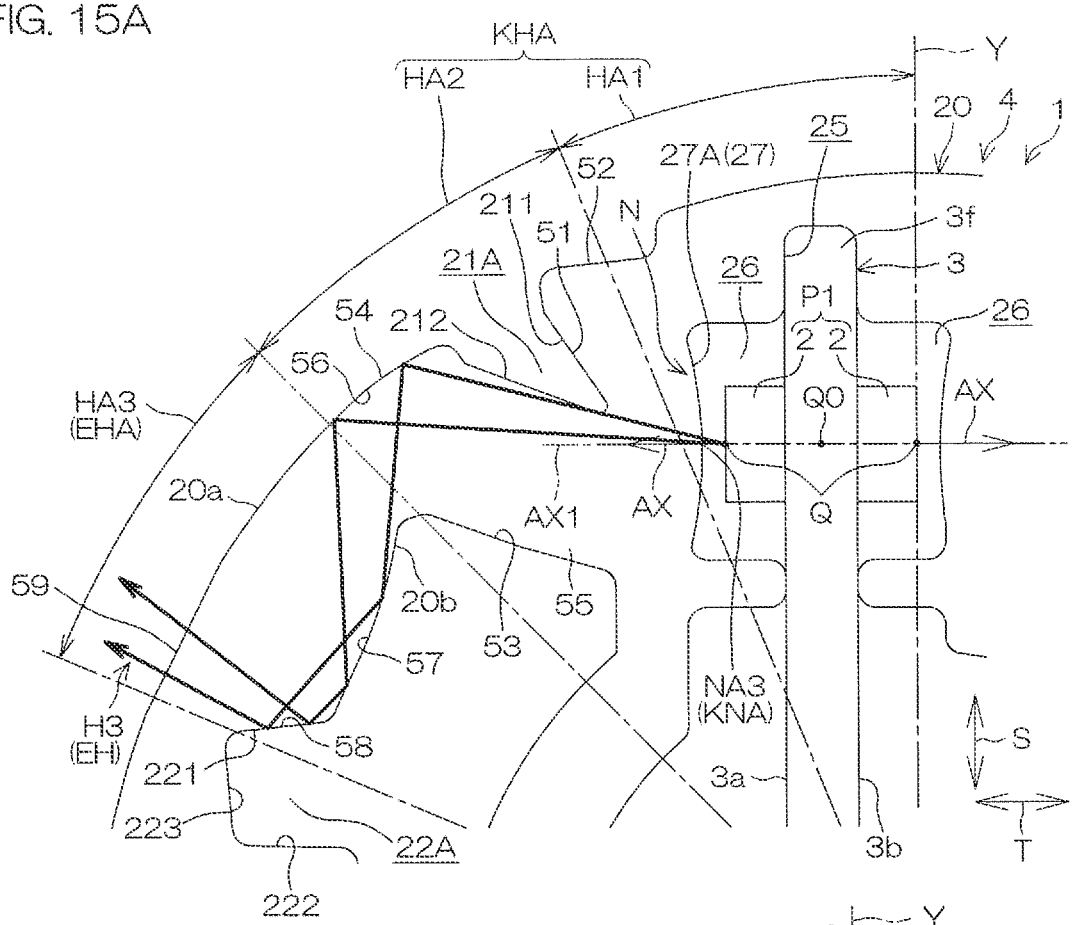
FIGS. 15A and 15B are enlarged cross-sectional views of major parts of the lens component, showing radiation characteristics of a third radiation mechanism and a fourth radiation mechanism on one side.
Figure 15B:
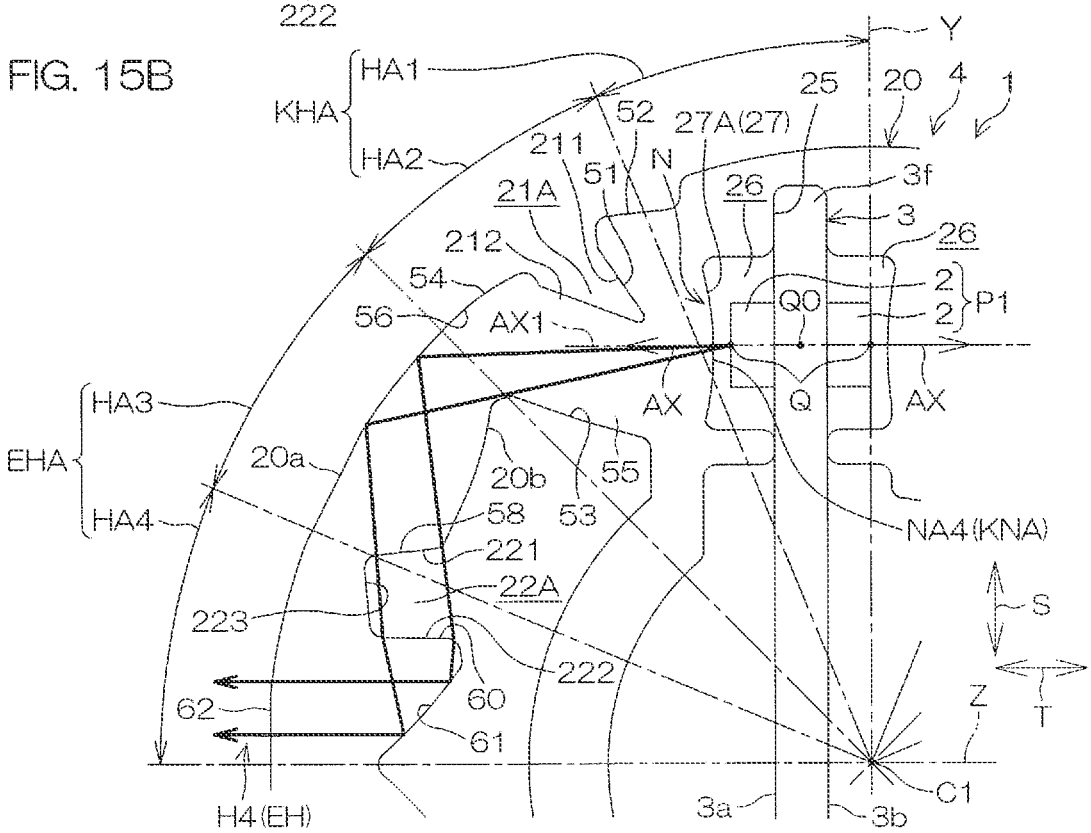

Specifically, the light guiding plate portion 55 guides the incident light from the incidence regions NA2, NA3, NA4 excluding the first incidence region NA1 among the plurality of incidence regions NA1 to NA4 of the incidence surface 27A (FIGS. 14B, 15A, and 15B). That is, it is possible to utilize the light guiding plate portion 55 to guide the incident light from the incidence regions excluding the first incidence region NA1.

Next, with reference to FIG. 15A, the third radiation mechanism H3 serving as the distant side radiation mechanism EH shall be described. As shown in FIG. 15A, the third radiation mechanism H3 includes a first light guiding surface 56, a second light guiding surface 57, a third reflection surface 58, and a third exit surface 59, and when viewed from the direction of the central axis line C1, radiates the light to the third radiation angle range HA3 serving as the distant side radiation angle range EHA adjacent to the opposite side of the first radiation angle range HA1 with respect to the second radiation angle range HA2.

The first light guiding surface 56 is a light guiding surface along the outer peripheral portion 20*a* of the light guiding radiation portion 20 and totally reflects the incident light from the third incidence region NA3 serving as the close side incidence region KNA of the incidence surface 27A. The second light guiding surface 57 is a light guiding surface along the inner peripheral portion 20*b* of the light guiding radiation portion 20 and totally reflects the reflected light from the first light guiding surface 56.

The inside axial groove 22A extending in the axial direction is formed in the inner peripheral portion 20*b* of the light guiding radiation portion 20. The inside axial groove 22A has a groove-shaped cross-section and is partitioned by first and second inner surfaces 221 and 222 opposing each other and a groove bottom surface 223.

The third reflection surface 58 is an internal reflection surface along the first inner surface 221 of the inside axial groove 22A formed in the inner peripheral portion 20*b* and totally reflects the reflected light from the second light guiding surface 57. The third exit surface 59 is provided in the outer peripheral portion 20*a* of the light guiding radiation portion 20 and transmits and exits the reflected light from the third reflection surface 58 to the third radiation angle range HA3.

That is, by an action of the third radiation mechanism H3, the light that is made incident from the third incidence region NA3 is totally reflected on, in order of, the first light guiding surface 56 along the outer peripheral portion 20*a*, the second light guiding surface 57 and the third reflection surface 58 along the inner peripheral portion 20*b*, and the reflected light from the third reflection surface 58 is transmitted and exited from the third exit surface 59 of the outer peripheral portion 20*a* to the third radiation angle range HA3. Since the third reflection surface 58 is formed by the internal reflection surface along the first inner surface 221 of the inside axial groove 22A formed in the inner peripheral portion 20*b* of the light guiding radiation portion 20, it is possible to easily obtain the desired third reflection surface 58 without increasing the size of the light guiding radiation portion 20.

The first light guiding surface 56 is disposed along the second exit surface 54 of the second radiation mechanism H2. Since the second exit surface 54 of the second radiation mechanism H2 and the first light guiding surface 56 of the third radiation mechanism H3 are formed by a common part, it is possible to achieve downsizing.

The second light guiding surface 57 and the third reflection surface 58 are disposed within a range of a central angle that defines the third radiation angle range HA3. Therefore, the second light guiding surface 57 and the third reflection surface 58 are collectively disposed, and it is thus possible to achieve downsizing. It is also possible to reduce the loss of light by shortening the optical path length in the light guiding radiation portion 20 in the third radiation mechanism H3.

At least one of the first light guiding surface 56, the second light guiding surface 57, and the third reflection surface 58 is preferably a light collecting surface (such as a concave lens surface), and in that case, it is possible to suppress diffusion of the light and improve visibility from the third radiation angle range HA3. In particular, forming all of the first light guiding surface 56, the second light guiding surface 57, and the third reflection surface 58 by light collecting surfaces is more preferable in terms of improving visibility.

Next, with reference to FIG. 15B, the fourth radiation mechanism H4 serving as the distant side radiation mechanism EH shall be described. As shown in FIG. 15B, the fourth radiation mechanism H4 includes the first light guiding surface 56 functioning as a reflection surface, the third reflection surface 58 functioning as a transmission surface, a re-incidence surface 60, a fourth reflection surface 61, and a fourth exit surface 62. The fourth radiation mechanism H4 radiates the light to the fourth radiation angle range HA4 serving as the distant side radiation angle range EHA adjacent to the third radiation angle range HA3 side with respect to the second axis line Z when viewed from the direction of the central axis line C1.

The first light guiding surface 56 in the fourth radiation mechanism H4 functions as the reflection surface which totally reflects the incident light from the fourth incidence region NA4 serving as the close side incidence region KNA. The third reflection surface 58 in the fourth radiation mechanism H4 functions as the transmission surface through which the reflected light from the first light guiding surface 56 is transmitted into the inside axial groove 22A.

The re-incidence surface 60 serves as the second inner surface 222 opposing the first inner surface 221 among the inner surfaces of the inside axial groove 22A and makes the transmitted light transmitted through the third reflection surface 58 incident again into the light guiding radiation portion 20. The fourth reflection surface 61 is an internal reflection surface along the inner peripheral portion 20*b* of the light guiding radiation portion 20 and totally reflects the re-incident light that is made incident from the re-incidence surface 60. The fourth exit surface 62 is provided in the outer peripheral portion 20*a* of the light guiding radiation portion 20 and transmits and exits the reflected light from the fourth reflection surface 61 to the fourth radiation angle range HA4.

That is, by an action of the fourth radiation mechanism H4, the incident light from the fourth incidence region NA4 is totally reflected on the first light guiding surface 56 along the outer peripheral portion 20*a* and the reflected light from the first light guiding surface 56 is transmitted via the third reflection surface 58 functioning as the transmission surface into the inside axial groove 22A. The transmitted light transmitted through the third reflection surface 58 is made incident again from the re-incidence surface 60 formed by the second inner surface 222 of the inside axial groove 22A into the light guiding radiation portion 20. The re-incident light from the re-incidence surface 60 is totally reflected on the fourth reflection surface 61 along the inner peripheral portion 20*b*. The reflected light from the fourth reflection surface 61 is transmitted and exited from the fourth exit surface 62 of the outer peripheral portion 20*a* to the fourth radiation angle range HA4. In the fourth radiation mechanism H4, the third reflection surface 58 of the third radiation mechanism H3 functions as the transmission surface. Therefore, without increasing the size of the light guiding radiation portion 20, it is possible to effectively utilize an interior of the light guiding radiation portion 20 as an optical path of the third radiation mechanism H3 and the fourth radiation mechanism H4.

The re-incidence surface 60 and the fourth reflection surface 61 are disposed within a range of a central angle that defines the fourth radiation angle range HA4. Since the re-incidence surface 60 and the fourth reflection surface are collectively disposed, it is possible to achieve downsizing. It is also possible to reduce the loss of light by shortening the optical path length in the light guiding radiation portion 20 in the fourth radiation mechanism H4.

The re-incidence surface 60 is preferably a light collecting surface (such as a concave lens surface), and it is possible to suppress diffusion of the light and improve visibility from the fourth radiation angle range HA4.

Specifically, the third reflection surface 58 functions as a light collecting reflection surface in the third radiation mechanism H3 and functions as a diffusing transmission surface in the fourth radiation mechanism H4.

That is, because the third reflection surface 58 functions as the light collecting reflection surface in the third radiation mechanism H3, the third reflection surface 58 functions as the diffusing transmission surface in the fourth radiation mechanism H4. Therefore, in a case where the re-incidence surface 60 includes a light collecting surface, it is possible to obtain a larger effect to suppress diffusion of the light and improve visibility of the fourth radiation angle range HA4.

When viewed from the direction of the central axis line C1 as shown in FIG. 11, in a range of 90° on the upper side with respect to the second axis line Z (on the light source side of the first pair P1) and on the right side of the first axis line Y (on the incidence surface 27B side), the light guiding radiation portion 20 includes the first radiation mechanism H1*b* that radiates the light to the first radiation angle range HA1*b*, the second radiation mechanism H2*b* that radiates the light to the second radiation angle range HA2*b*, the third radiation mechanism H3*b* that radiates the light to the third radiation angle range HA3*b*, and the fourth radiation mechanism H4*b* that radiates the light to the fourth radiation angle range HA4*b*.

Arrangements and functions of the first radiation mechanism H1*b*, the second radiation mechanism H2*b*, the third radiation mechanism H3*b*, and the fourth radiation mechanism H4*b* are respectively substantially common to the arrangements and the functions of the first radiation mechanism H1, the second radiation mechanism H2, the third radiation mechanism H3, and the fourth radiation mechanism H4 described above.

Figure 16A:
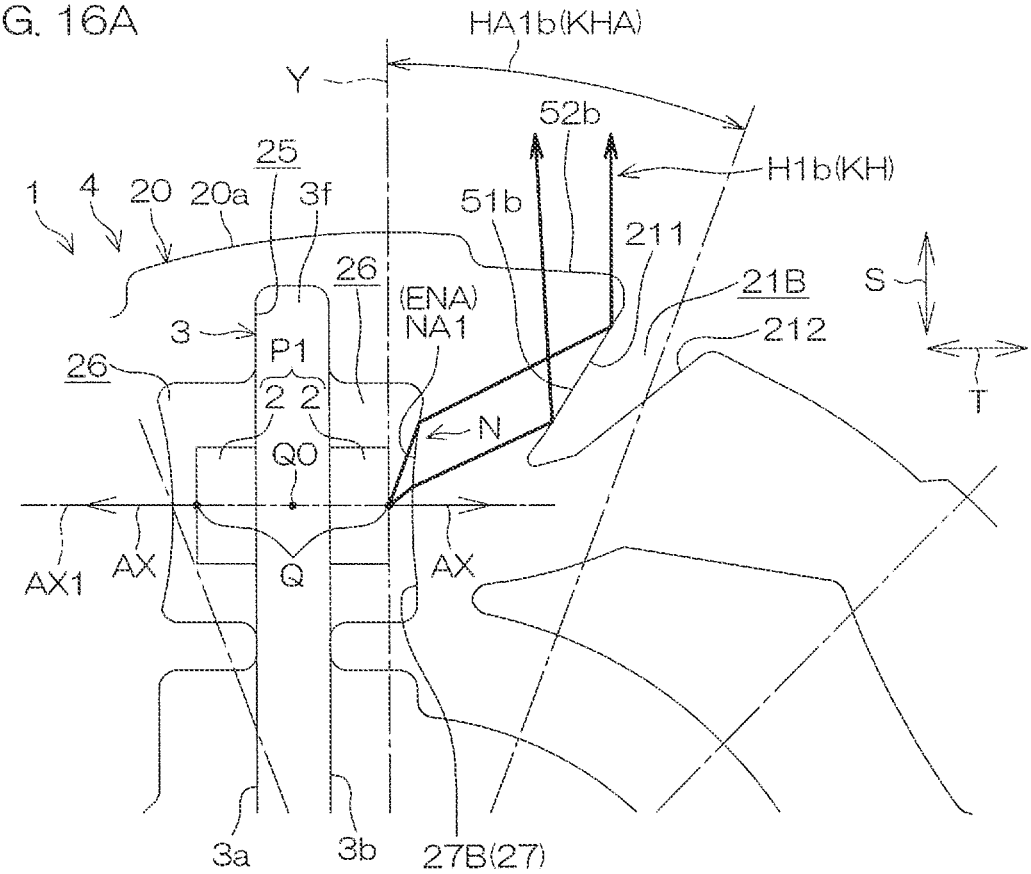
FIGS. 16A and 16B are enlarged cross-sectional views of major parts of the lens component, showing radiation characteristics of the first radiation mechanism and the second radiation mechanism on the other side.

That is, with reference to FIG. 16A, a first reflection surface 51*b* and a first exit surface 52*b* in the first radiation mechanism H1*b* respectively correspond to the first reflection surface 51 and the first exit surface 52 in the first radiation mechanism H1 described above (see FIG. 14A). The outside axial groove 21B corresponds to the outside axial groove 21A (see FIG. 14A). In the first radiation mechanism H1*b*, the light that is made incident from the first incidence region NA1 serving as the distant side incidence region ENA is totally reflected on the first reflection surface 51*b*, transmitted and exited from the first exit surface 52*b*, and radiated to the first radiation angle range HA1*b* serving as the close side radiation angle range KHA.

Figure 16B:
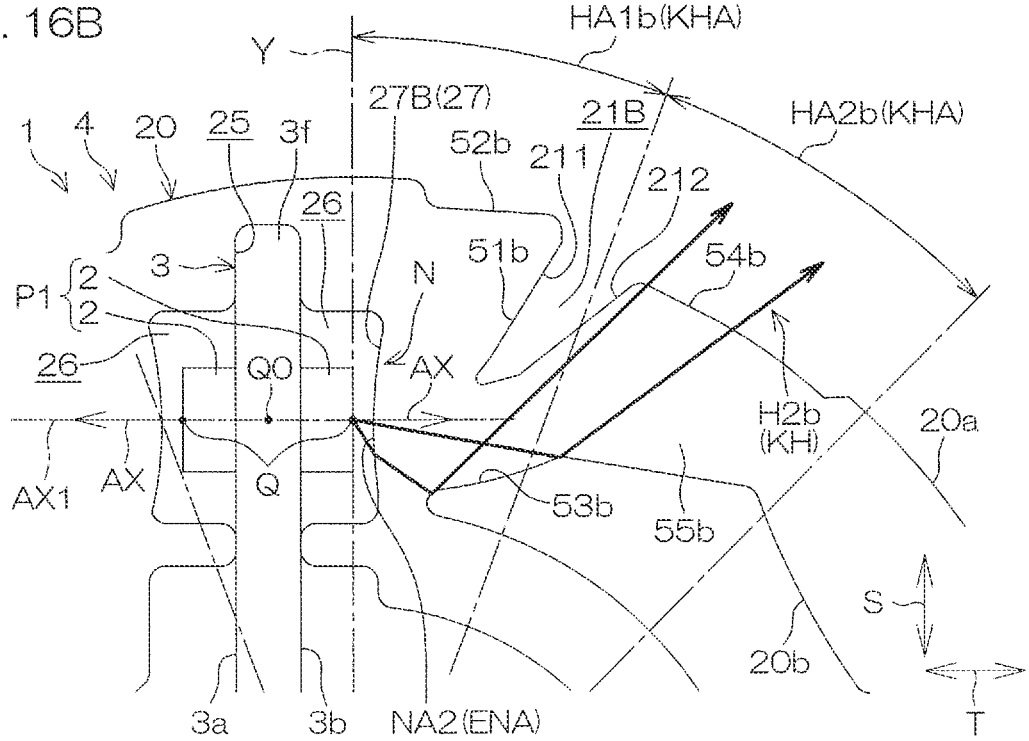

With reference to FIG. 16B, a second reflection surface 53*b* and a second exit surface 54*b* in the second radiation mechanism H2*b* respectively correspond to the second reflection surface 53 and the second exit surface 54 in the second radiation mechanism H2 described above (see FIG. 14B). In the second radiation mechanism H2*b*, the light that is made incident from the second incidence region NA2 serving as the distant side incidence region ENA is totally reflected on the second reflection surface 53*b* and radiated to the second radiation angle range HA2*b* serving as the close side radiation angle range KHA via the second exit surface 54*b*.

Figure 17A:
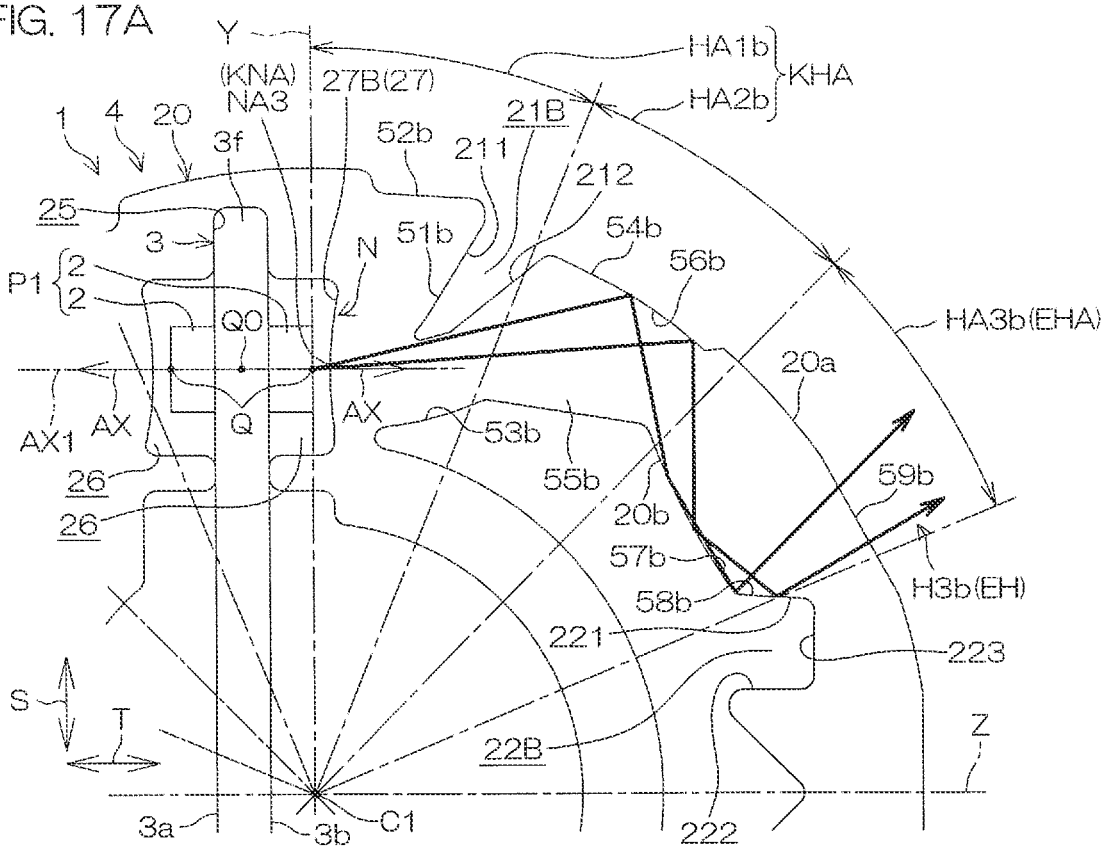
FIGS. 17A and 17B are enlarged cross-sectional views of major parts of the lens component, showing radiation characteristics of the third radiation mechanism and the fourth radiation mechanism on the other side.

With reference to FIG. 17A, a first light guiding surface 56*b*, a second light guiding surface 57*b*, a third reflection surface 58*b*, and a third exit surface 59*b* in the third radiation mechanism H3*b* respectively correspond to the first light guiding surface 56, the second light guiding surface 57, the third reflection surface 58, and the third exit surface 59 in the third radiation mechanism H3 described above (see FIG. 15A). The inside axial groove 22B corresponds to the inside axial groove 22A (FIG. 15A).

In the third radiation mechanism H3*b*, the light that is made incident from the third incidence region NA3 serving as the close side incidence region KNA is totally reflected successively on the first light guiding surface 56*b*, the second light guiding surface 57*b*, and the third reflection surface 58*b*, and radiated to the third radiation angle range HA3*b* serving as the distant side radiation angle range EHA via the third exit surface 59*b*.

Figure 17B:
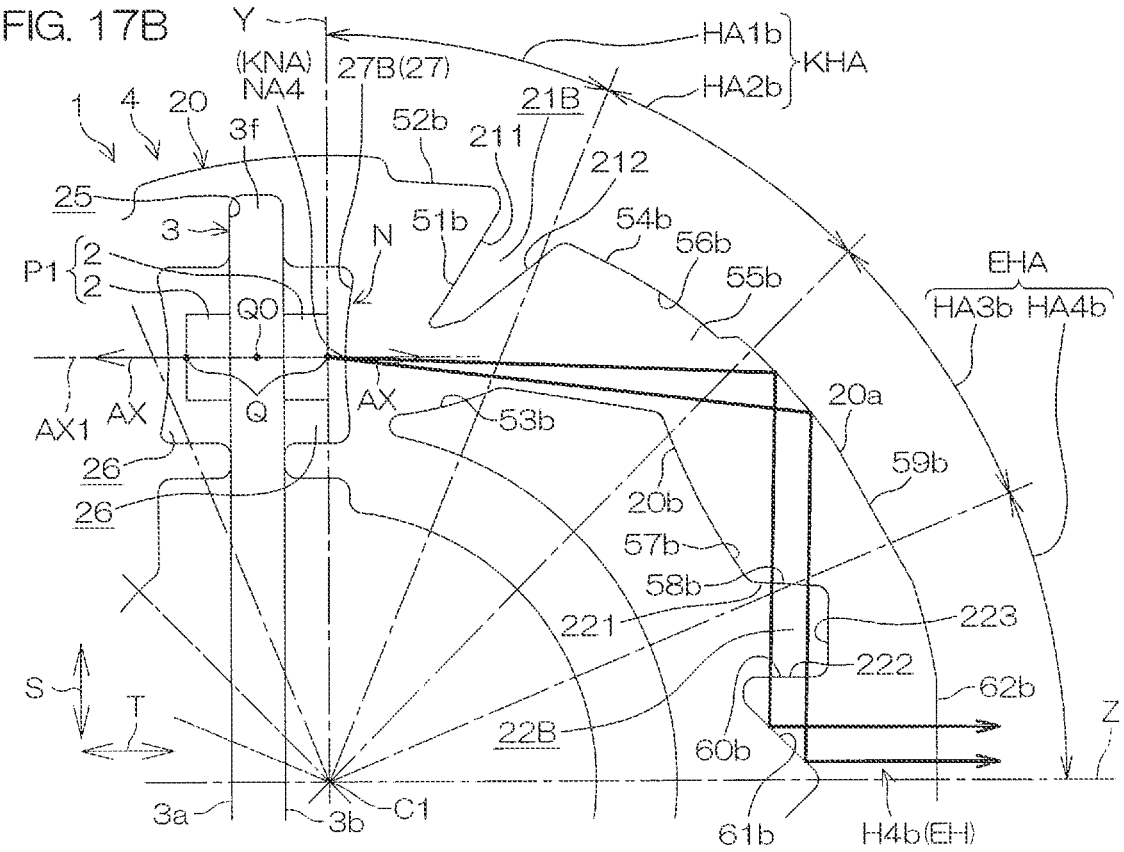

With reference to FIG. 17B, the first light guiding surface 56*b*, the third reflection surface 58*b*, a re-incidence surface 60*b*, a fourth reflection surface 61*b*, and a fourth exit surface 62*b* in the fourth radiation mechanism H4*b* respectively correspond to the first light guiding surface 56, the third reflection surface 58, the re-incidence surface 60, the fourth reflection surface 61, and the fourth exit surface 62 in the fourth radiation mechanism H4 described above (see FIG. 15B).

In the fourth radiation mechanism H4*b*, the light that is made incident from the fourth incidence region NA4 serving as the close side incidence region KNA is reflected on the first light guiding surface 56*b* functioning as a reflection surface, then transmitted through the third reflection surface 58*b* functioning as a transmission surface to the inside axial groove 22B side, then made incident again from the re-incidence surface 60, totally reflected on the fourth reflection surface 61*b*, and radiated to the fourth radiation angle range HA4*b* serving as the distant side radiation angle range EHA via the fourth exit surface 62*b*.

When viewed from the direction of the central axis line C1 as shown in FIG. 11, the arrangement of the light guiding radiation portion 20 in a range of 180° on the lower side with respect to the second axis line Z (on the light source side of the second pair P2) and the arrangement of the light guiding radiation portion 20 in a range of 180° on the upper side with respect to the second axis line Z (on the light source side of the first pair P1) are arranged to be symmetrical with respect to the second axis line Z.

Specifically, the first radiation mechanism H1*c* that radiates the light to the first radiation angle range HA1*c*, the second radiation mechanism H2*c* that radiates the light to the second radiation angle range HA2*c*, the third radiation mechanism H3*c* that radiates the light to the third radiation angle range HA3*c*, and the fourth radiation mechanism H4*c* that radiates the light to the fourth radiation angle range HA4*c* respectively correspond to the first radiation mechanism H1, the second radiation mechanism H2, the third radiation mechanism H3, and the fourth radiation mechanism H4.

The first radiation mechanism Hid that radiates the light to the first radiation angle range HA1*d*, the second radiation mechanism H2*d* that radiates the light to the second radiation angle range HA2*d*, the third radiation mechanism H3*d* that radiates the light to the third radiation angle range HA3*d*, and the fourth radiation mechanism H4*d* that radiates the light to the fourth radiation angle range HA4*d* respectively correspond to the first radiation mechanism Hib, the second radiation mechanism H2*b*, the third radiation mechanism H3*b*, and the fourth radiation mechanism H4*b*.

With the lens components 4 of the present preferred embodiment, the following effects are exerted.

That is, as shown in FIG. 11, for light guiding for radiating to the close side radiation angle range KHA on the side close to the first axis line Y, a light guiding distance in the light guiding radiation portion 20 is relatively short, and the loss of light at the time of light guiding is relatively small. For light guiding for radiating to the distant side radiation angle range EHA on the side close to the second axis line Z side and far from the first axis line Y, the light guiding distance in the light guiding radiation portion 20 is relatively long, and the loss of light at the time of light guiding is relatively large.

Thus, in the present preferred embodiment, light of relatively high luminosity is made incident on the close side incidence region KNA on the side close to the optical axis line AX1 (see FIG. 13A) is radiated to the distant side radiation angle range EHA via the corresponding radiation mechanism H. Light of relatively low luminosity is made incident on the distant side incidence region ENA on the side far from the optical axis line AX1 (see FIG. 13A) is radiated to the close side radiation angle range KHA via the corresponding radiation mechanism H. Therefore, by suppressing an influence of the loss of light at the time of light guiding, it is possible to radiate to an entire region in the circumferential direction with a uniform amount of light, and improve visibility.

In other words, the light of relatively high luminosity is made incident on the close side incidence region KNA is guided to the optical path on the side where the optical path length is relatively long and the loss of light becomes relatively large, that is, on the side where the light is radiated to the distant side radiation angle range EHA. The light of relatively low luminosity is made incident on the distant side incidence region ENA is guided to the optical path on the side where the optical path length is relatively short and the loss of light becomes relatively small, that is, on the side where the light is radiated to the close side radiation angle range KHA. Therefore, it is possible to radiate to an entire region in the circumferential direction with a uniform amount of light, and improve visibility.

As shown in FIG. 13A, the third incidence region NA3 and the fourth incidence region NA4 serving as the close side incidence region KNA are disposed on both sides of the optical axis line AX1 and disposed between the first incidence region NA1 and the second incidence region NA2. Thereby, it is possible to effectively use the incidence regions.

The incident light from the first incidence region NA1 and the second incidence region NA2 serving as the distant side incidence region ENA is guided via the corresponding radiation mechanisms H and respectively radiated to the first radiation angle range HA1 and the second radiation angle range HA2 serving as the close side radiation angle range KHA. The incident light from the third incidence region NA3 and the fourth incidence region NA4 serving as the close side incidence region KNA is guided via the corresponding radiation mechanisms H and respectively radiated to the third radiation angle range HA3 and the fourth radiation angle range HA4 serving as the distant side radiation angle range EHA. Thereby, it is possible to establish a practical correspondence between each of the incidence regions and each of the radiation angle ranges.

The plurality of radiation mechanisms H are arranged to radiate the light by a mutually equal amount of light. Therefore, it is possible to suppress unevenness of visibility in the circumferential direction of the lens components 4, and further improve visibility.

With the signal display lamp 1 including the lens components 4 and the light sources (LEDs 2) disposed at the light source positions Q, it is possible to obtain operations and effects related to the lens components 4 described above.

As shown in FIGS. 7 and 11, by including, as the light sources, the first pair P1 of light sources (LEDs 2) that share the optical axes AX with each other and emit light in directions directly opposite to each other, it is possible to enhance visibility over a wide range in the circumferential direction. In particular, the second pair P2 of light sources (LEDs 2) that share the optical axes AX with each other and emit light in directions directly opposite to each other are included and the first pair P1 of light sources and the second pair P2 of light sources are positioned on opposite sides to each other in the direction of the first axis line Y with respect to the central axis line C1. Therefore, each of the light sources corresponds to one-fourth of the entire circumference of the radiation angle ranges, and it is possible to improve the amount of light and enhance visibility.

As shown in FIGS. 3, 7, and 11, the substrate 3 having the direction of the central axis line C1 as the longitudinal direction L and the direction of the first axis line Y as the short direction S is included, and each of the pairs P1, P2 of light sources are respectively mounted on the front surface 3*a* and the rear surface 3*b* of the substrate 3. The lens component 4 is formed in a cylindrical shape, and the pair of holding grooves 25 in the axial direction which respectively house and hold the pair of end edges 3*f*, 3*g* of the short direction S of the substrate 3 are formed in the inner peripheral portion 20*b* of the light guiding radiation portion 20 of the lens component 4. Each of the pairs P1, P2 of light sources are respectively disposed at the light source positions Q on both sides of the substrate 3 via the substrate 3. Therefore, in the substrate 3 having the direction of the central axis line C1 of the light guiding radiation portion 20 as the longitudinal direction L, by holding the pair of end edges 3*f*, 3*g* of the short direction S by the holding grooves 25 in the axial direction of the light guiding radiation portion 20, it is possible to realize the signal display lamp 1 with a practical structure.

As shown in FIG. 11, the substrate 3 is disposed so as to offset in the direction of the second axis line Z with respect to the central axis line C1. Therefore, it is possible to increase the degree of freedom of design. It is also possible to ensure a space on the opposite side to the offset side.

As shown in FIG. 3, the plurality of cylindrical lens components 4 are capable of being coupled in the axial direction X and the coupling portions of the adjacent lens components 4 (first and second coupling portions 41 and 42) are fitted and coupled to each other. Therefore, by coupling the desired number of lens components 4 in the axial direction X, it is possible to realize the signal display lamp 1 having a different length.

Figure 18:
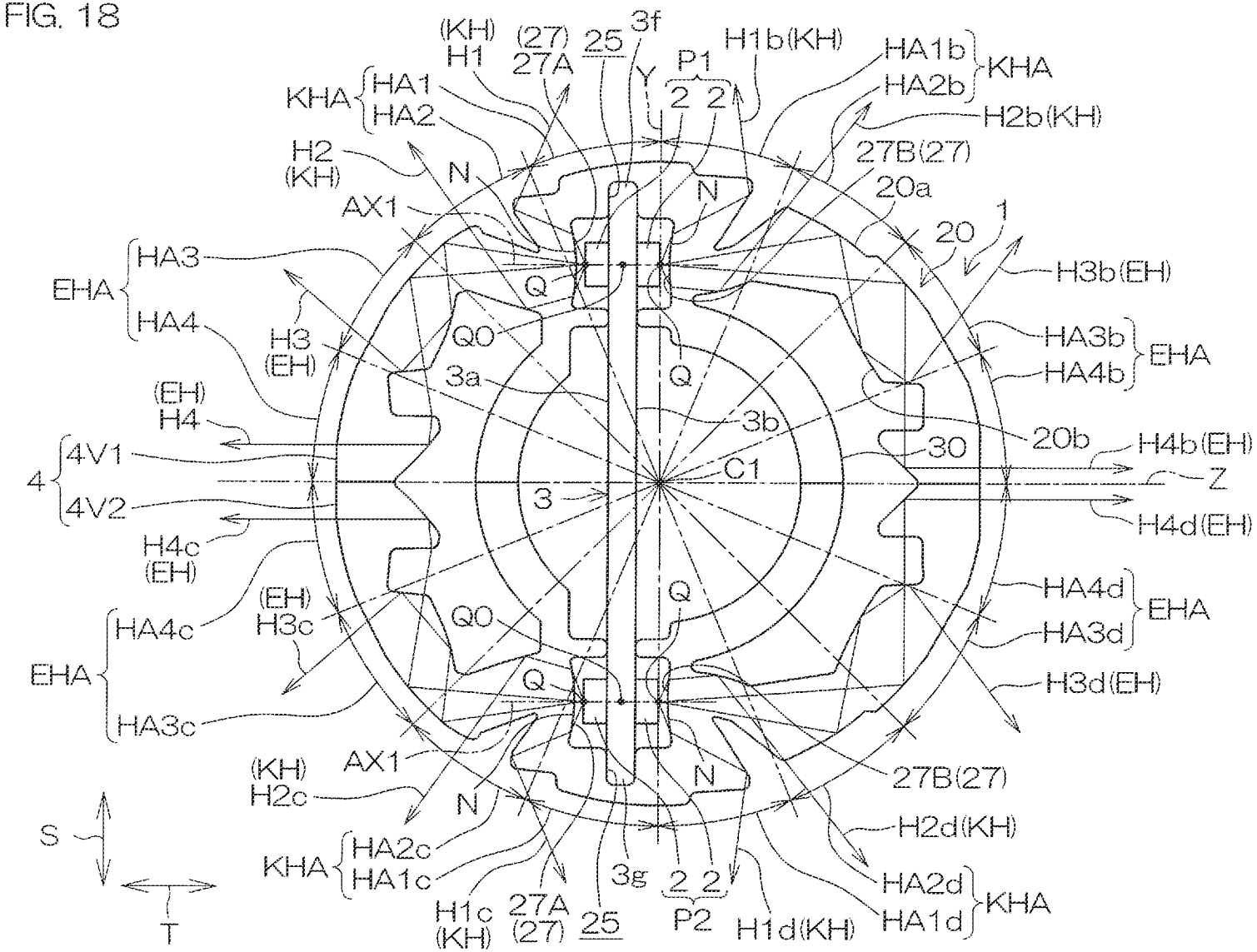
FIG. 18 is a transverse cross-sectional view of major parts of the signal display lamp showing a modified example of the lens component.

FIG. 18 is a transverse cross-sectional view showing a modified example of the lens component 4 of the signal display lamp 1. As shown in FIG. 18, the lens component 4 includes a plurality of divided pieces 4V1 and 4V2 divided in the circumferential direction and combined with each other. The lens component 4 may be divided along the second axis line Z, for example. Since a shape of the divided pieces of the lens component 4 is simplified as compared to a case where the lens component 4 is not divided, it is easy to manufacture. It is also possible to realize the lens component 4 corresponding to various angle ranges by using basic parts in a small variety of types.

Figure 19:
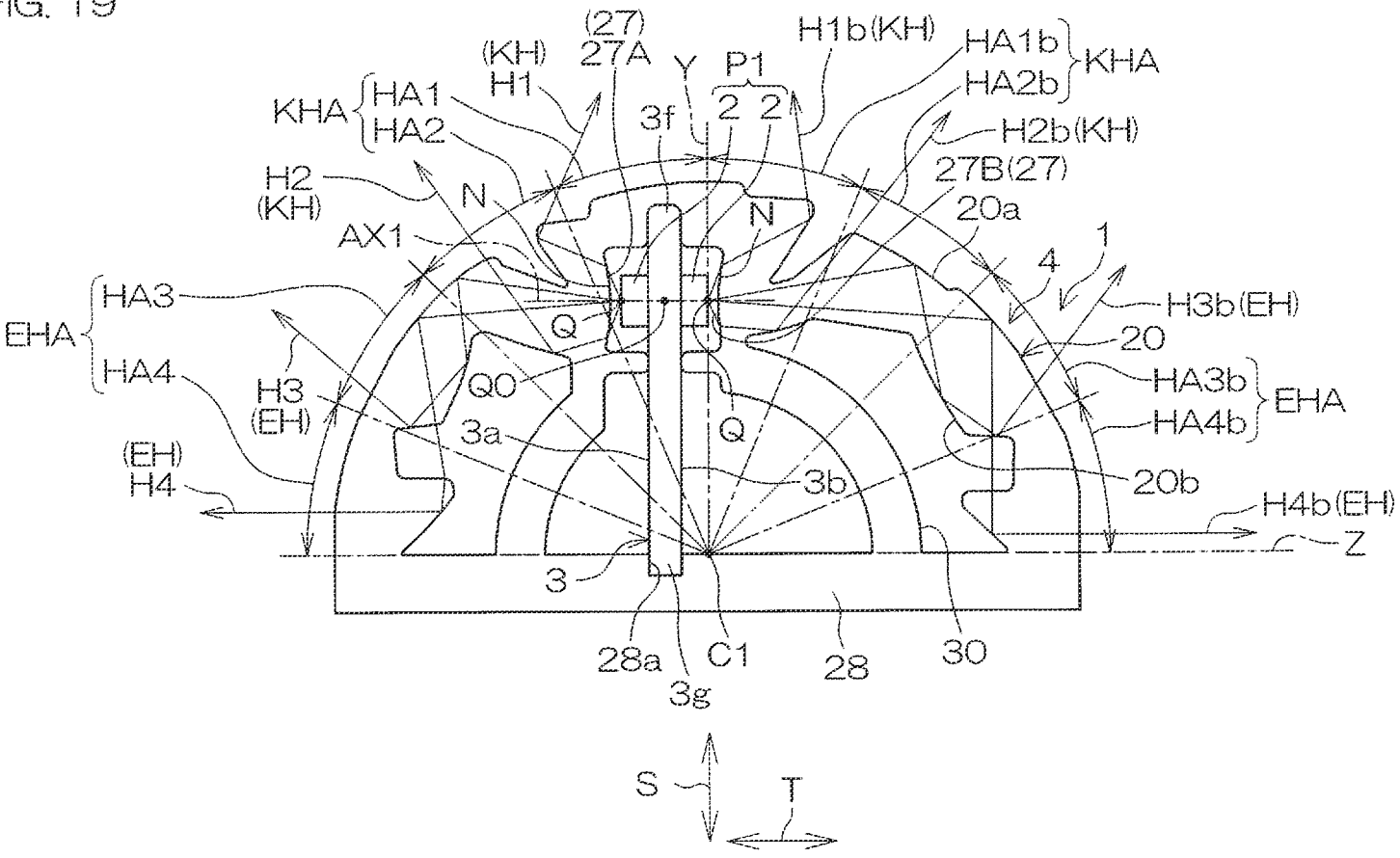
FIG. 19 is a transverse cross-sectional view of major parts of the signal display lamp showing another modified example of the lens component.

FIG. 19 is a transverse cross-sectional view showing still another modified example of the lens component 4 of the signal display lamp 1. As shown in FIG. 19, when viewed from the direction of the central axis line C1, the lens component 4 assumes a partially cylindrical shape with the second axis line Z as a chord. The lens component 4 includes a support plate portion 28 extending along the chord and the support plate portion 28 couples the light guiding radiation portion 20 and the coupling structure portion 30 which form the partially cylindrical shape together. The support plate portion 28 includes a holding groove 28*a* that holds the second end edge 3*g* of the substrate 3. In the example of FIG. 19, it is possible to radiate to, on both sides across the first axis line Y from the first pair P1 of light sources (LEDs 2), the radiation angle range of 90° for each side, that is, 180° in total.

Figure 20:
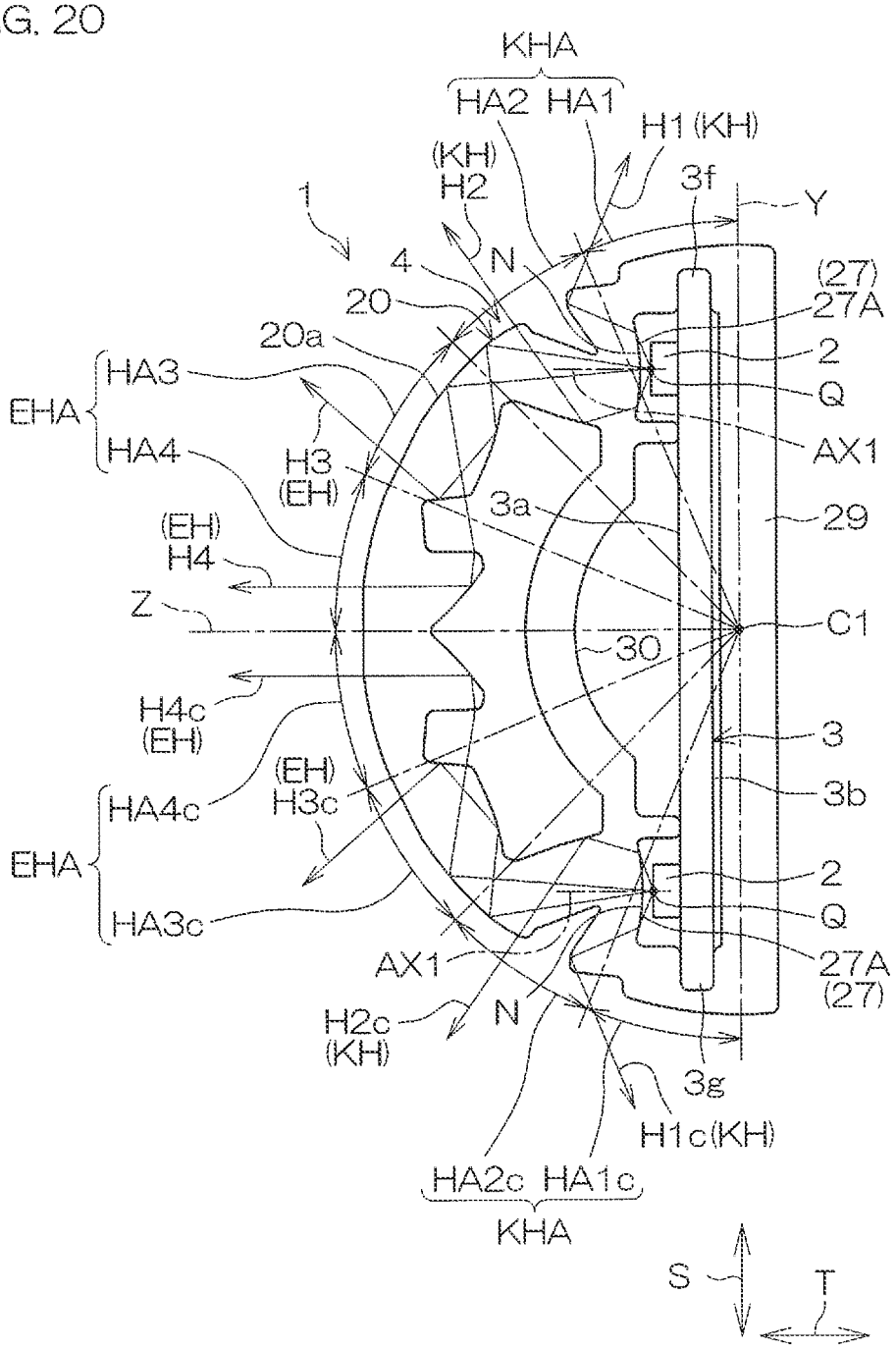
FIG. 20 is a transverse cross-sectional view of major parts of the signal display lamp showing still another modified example of the lens component.

FIG. 20 is a transverse cross-sectional view showing still another modified example of the lens component 4 of the signal display lamp 1. As shown in FIG. 20, when viewed from the direction of the central axis line C1, the lens component 4 assumes a partially cylindrical shape with the first axis line as a chord. The lens component 4 includes a support plate portion 29 extending along the chord and the support plate portion 29 couples parts opposing in the direction of the first axis line Y in the light guiding radiation portion 20. The light source includes a pair of light sources (LEDs 2) which are positioned on opposite sides to each other in the direction of the first axis line Y with respect to the central axis line C1 and emit light on the same side in a direction parallel to the second axis line Z. In this case, it is possible to radiate to, on both sides across the second axis line Z from the pair of light sources (LEDs 2) that emit light on the same side, the radiation angle range of 90° for each side, that is, 180° in total.

The present invention is not limited to the preferred embodiment described above, and for example, when viewed from the direction of the central axis line C1, the central position in the thickness direction T of the substrate 3 may be disposed on the central axis line C1. That is, the substrate 3 may be disposed without offsetting. In this case, since symmetry of the lens component is enhanced, it is possible to simplify the structure. In addition, it is possible to make various modifications to the present invention within a range of the description in the claims.

REFERENCE SIGNS LIST

1 . . . signal display lamp
2 . . . LED (light source)
3 . . . substrate
3*a* . . . front surface
3*b* . . . rear surface
3*f* . . . first end edge
3*g* . . . second end edge
4; 4A to 4D . . . lens component
4V1; 4V2 . . . divided piece
20 . . . light guiding radiation portion
20*a* . . . outer peripheral portion
20*b* . . . inner peripheral portion
21A to 21D . . . outside axial groove
22A to 22D . . . inside axial groove
25 . . . holding groove
26 . . . light source housing recessed portion
27; 27A; 27B . . . incidence surface
30 . . . coupling structure portion
41 . . . first coupling portion
42 . . . second coupling portion
43 . . . fitting groove
51; 51*b* . . . first reflection surface
52; 52*b* . . . first exit surface
53; 53*b* . . . second reflection surface
54; 54*b* . . . second exit surface
55 . . . light guiding plate portion
56; 56*b* . . . first light guiding surface
57; 57*b* . . . second light guiding surface
58; 58*b* . . . third reflection surface
59; 59*b* . . . third exit surface
60; 60*b* . . . re-incidence surface
61; 61*b* . . . fourth reflection surface
62; 62*b* . . . fourth exit surface
211 . . . first inner surface
212 . . . second inner surface
221 . . . first inner surface
222 . . . second inner surface
AX . . . optical axis
AX1 . . . optical axis line
C1 . . . central axis line
EH . . . distant side radiation mechanism
EHA . . . distant side radiation angle range
ENA . . . distant side incidence region
H1; H1*b* to H1*d* . . . first radiation mechanism
H2; H2*b* to H2*d* . . . second radiation mechanism
H3; H3*b* to H3*d* . . . third radiation mechanism
H4; H4*b* to H4*d* . . . fourth radiation mechanism
HA1; HA1*b* to HA1*d* . . . first radiation angle range
HA2; HA2*b* to HA2*d* . . . second radiation angle range
HA3; HA3*b* to HA3*d* . . . third radiation angle range
HA4; HA4*b* to HA4*d* . . . fourth radiation angle range
KH . . . close side radiation mechanism
KHA . . . close side radiation angle range
KNA . . . close side incidence region
L . . . longitudinal direction
N . . . light incidence portion
NA . . . incidence region
NA1 . . . first incidence region
NA2 . . . second incidence region
NA3 . . . third incidence region
NA4 . . . fourth incidence region
P1 . . . first pair
P2 . . . second pair
Q . . . light source position
Q0 . . . central position
S . . . short direction
T . . . thickness direction
X . . . axial direction
Y . . . first axis line
Z . . . second axis line

The invention claimed is:

1. A lens component for radiating to a periphery light emitted by a light source having a light distribution characteristic in which luminosity becomes smaller with an increase in distance away from an optical axis, comprising:

a light guiding radiation portion formed in a cylindrical or partially cylindrical shape having a central axis line and having an outer peripheral portion and an inner peripheral portion guides the light from the light source disposed at a predetermined light source position separated from a second axis line among first and second axis lines which are orthogonal to the central axis line and orthogonal to each other in a direction of the first axis line by aligning the optical axis with an optical axis line which is parallel to the second axis line and that radiates the light radially away from the central axis line toward a periphery of the central axis line, wherein the light guiding radiation portion includes a light incidence portion having an incidence surface on which the light from the light source disposed at the light source position is made incident and a plurality of radiation mechanisms that respectively guide and radiate the light that is made incident from the light incidence portion to a plurality of radiation angle ranges respectively defined by a plurality of central angles centered on the central axis line, the incidence surface includes a plurality of incidence regions which collect the light from the light source disposed at the light source position and respectively make the light incident on the plurality of radiation mechanisms, the plurality of incidence regions include a close side incidence region close to the optical axis line, and a distant side incidence region disposed farther from the optical axis line than the close side incidence region, when viewed from a direction of the central axis line, the plurality of radiation angle ranges include a close side radiation angle range closer to the first axis line than the second axis line and a distant side radiation angle range farther from the first axis line and closer to the second axis line than the close side radiation angle range, the radiation mechanisms include a close side radiation mechanism that radiates the light to the close side radiation angle range and a distant side radiation mechanism that radiates the light to the distant side radiation angle range, the light that is made incident on the close side incidence region is radiated to the distant side radiation angle range via the corresponding distant side radiation mechanism, and the light that is made incident on the distant side incidence region is radiated to the close side radiation angle range via the corresponding close side radiation mechanism.

2. The lens component according to claim 1, wherein an optical path length in the light guiding radiation portion before the light that is made incident on the close side incidence region is radiated to the distant side radiation angle range via the corresponding distant side radiation mechanism is longer than an optical path length in the light guiding radiation portion before the light that is made incident on the distant side incidence region is radiated to the close side radiation angle range via the corresponding close side radiation mechanism.

3. The lens component according to claim 1, wherein the distant side incidence region includes first and second incidence regions disposed on opposite sides to each other with respect to the optical axis line and the close side incidence region includes a third incidence region disposed between the first incidence region and the optical axis line and a fourth incidence region disposed between the second incidence region and the optical axis line, when viewed from the direction of the central axis line, the close side radiation angle range includes a first radiation angle range adjacent to the first axis line and a second radiation angle range adjacent to the opposite side of the first axis line with respect to the first radiation angle range, and when viewed from the direction of the central axis line, the distant side radiation angle range includes a third radiation angle range adjacent to the opposite side of the first radiation angle range with respect to the second radiation angle range and a fourth radiation angle range adjacent to the third radiation angle range side with respect to the second axis line, and incident light from the first incidence region, the second incidence region, the third incidence region, and the fourth incidence region is guided via the corresponding radiation mechanisms and respectively radiated to the first radiation angle range, the second radiation angle range, the third radiation angle range, and the fourth radiation angle range.

4. The lens component according to claim 1, wherein the close side radiation mechanism includes a first radiation mechanism that radiates light to the first radiation angle range serving as the close side radiation angle range adjacent to the first axis line when viewed from the direction of the central axis line, and the first radiation mechanism includes a first reflection surface which is an internal reflection surface along a first inner surface opposing the rear side of the incidence surface among inner surfaces of an outside axial groove formed in the outer peripheral portion and totally reflects the incident light from the first incidence region serving as the distant side incidence region of the incidence surface and a first exit surface which is provided in the outer peripheral portion and transmits and exits the reflected light from the first reflection surface to the first radiation angle range.

5. The lens component according to claim 4, wherein when viewed from the direction of the central axis line, the first reflection surface is disposed within a range of a central angle that defines a second radiation angle range adjacent to the opposite side of the first axis line with respect to the first radiation angle range.

6. The lens component according to claim 4, wherein the first reflection surface includes a light collecting surface and the first exit surface includes a refractive surface which refracts and emits the reflected light from the first reflection surface such as to lead the reflected light to the central side of the first radiation angle range.

7. The lens component according to claim 4, wherein the close side radiation mechanism includes a second radiation mechanism that radiates light to the second radiation angle range serving as the close side radiation angle range adjacent to the opposite side of the first axis line with respect to the first radiation angle range when viewed from the direction of the central axis line, and the second radiation mechanism includes a second reflection surface which is an internal reflection surface along the inner peripheral portion and totally reflects the incident light from the second incidence region serving as the distant side incidence region of the incidence surface and a second exit surface which is provided in the outer peripheral portion and transmits and exits the reflected light from the second reflection surface to the second radiation angle range.

8. The lens component according to claim 7, wherein the second exit surface includes a refractive surface which refracts and emits the reflected light from the second reflection surface such as to lead the reflected light to the central side of the second radiation angle range.

9. The lens component according to claim 7, wherein the distant side radiation mechanism includes a third radiation mechanism that radiates light to the third radiation angle range serving as the distant side radiation angle range adjacent to the opposite side of the first radiation angle range with respect to the second radiation angle range when viewed from the direction of the central axis line, and the third radiation mechanism includes a first light guiding surface which is a light guiding surface along the outer peripheral portion and totally reflects the incident light from the third incidence region serving as the close side incidence region of the incidence surface, a second light guiding surface which is a light guiding surface along the inner peripheral portion and totally reflects the reflected light from the first light guiding surface, a third reflection surface which is an internal reflection surface along a first inner surface of an inside axial groove formed in the inner peripheral portion and totally reflects the reflected light from the second light guiding surface and a third exit surface which is provided in the outer peripheral portion and transmits and exits the reflected light from the third reflection surface to the third radiation angle range.

10. The lens component according to claim 9, wherein the first light guiding surface is disposed along the second exit surface of the second radiation mechanism and the second light guiding surface and the third reflection surface are disposed within a range of a central angle that defines the third radiation angle range.

11. The lens component according to claim 9, wherein the distant side radiation mechanism includes a fourth radiation mechanism that radiates light to the fourth radiation angle range serving as the distant side radiation angle range adjacent to the third radiation angle range side with respect to the second axis line when viewed from the direction of the central axis line, and the fourth radiation mechanism includes the first light guiding surface functioning as a reflection surface which totally reflects the incident light from the fourth incidence region serving as the close side incidence region of the incidence surface, the third reflection surface functioning as a transmission surface which transmits the reflected light from the first light guiding surface into the inside axial groove, a re-incidence surface serving as a second inner surface which opposes the first inner surface among the inner surfaces of the inside axial groove and makes the transmitted light transmitted through the third reflection surface incident again, a fourth reflection surface which is an internal reflection surface along the inner peripheral portion of the light guiding radiation portion and totally reflects the re-incident light that is made incident from the re-incidence surface, and a fourth exit surface which is provided in the outer peripheral portion and transmits and exits the reflected light from the fourth reflection surface to the fourth radiation angle range.

12. The lens component according to claim 11, wherein the re-incidence surface and the fourth reflection surface are disposed within a range of a central angle that defines the fourth radiation angle range.

13. The lens component according to claim 11, wherein the third reflection surface functions as a light collecting reflection surface in the third radiation mechanism and functions as a diffusing transmission surface in the fourth radiation mechanism.

14. A signal display lamp comprising:

the lens component according to claim 1; and a light source disposed at a light source position of the lens component.

15. The signal display lamp according to claim 14, wherein the light source includes a first pair of light sources and/or a second pair of light sources that share optical axes with each other and emit light in directions directly opposite to each other, and the first pair of light sources and/or the second pair of light sources are positioned on opposite sides to each other in the direction of the first axis line with respect to the central axis line.

16. The signal display lamp according to claim 15, wherein when viewed from the direction of the central axis line, the lens component assumes a partially cylindrical shape with the second axis line as a chord.

17. The signal display lamp according to claim 14, wherein when viewed from the direction of the central axis line, the lens component assumes a partially cylindrical shape with the first axis line as a chord, and the light source includes a pair of light sources which are positioned on opposite sides to each other in the direction of the first axis line with respect to the central axis line and emit light on the same side in a direction parallel to the second axis line.

* * * * *